US009215791B2

(12) United States Patent
Arita et al.

(10) Patent No.: US 9,215,791 B2
(45) Date of Patent: Dec. 15, 2015

(54) PARTICLE BEAM SYSTEM AND PATTERN DATA GENERATION METHOD FOR PARTICLE BEAM SYSTEM

(71) Applicant: Hitachi, Ltd., Tokyo (JP)

(72) Inventors: Haruki Arita, Tokyo (JP); Moemi Takeda, Tokyo (JP)

(73) Assignee: HITACHI, LTD., Tokyo (JP)

( * ) Notice: Subject to any disclaimer, the term of this patent is extended or adjusted under 35 U.S.C. 154(b) by 0 days.

(21) Appl. No.: 14/090,765

(22) Filed: Nov. 26, 2013

(65) Prior Publication Data

US 2014/0152199 A1 Jun. 5, 2014

(30) Foreign Application Priority Data

Dec. 3, 2012 (JP) ..... 2012-264317

(51) Int. Cl.

| | |
|---|---|
| ***H05H 7/04*** | (2006.01) |
| ***H05H 13/04*** | (2006.01) |
| ***H05H 15/00*** | (2006.01) |
| *H05H 7/00* | (2006.01) |

(52) U.S. Cl.

CPC ..... *H05H 13/04* (2013.01); *H05H 7/04* (2013.01); *H05H 2007/008* (2013.01)

(58) Field of Classification Search

CPC ..... H05H 13/04; H05H 7/04; H05H 7/00
USPC ..... 315/503; 250/492.1, 492.3
See application file for complete search history.

(56) References Cited

U.S. PATENT DOCUMENTS

| | | | | |
|---|---|---|---|---|
| 6,462,490 | B1 * | 10/2002 | Matsuda et al. | 315/507 |
| 6,580,084 | B1 * | 6/2003 | Hiramoto et al. | 250/505.1 |
| 7,977,656 | B2 * | 7/2011 | Fujimaki et al. | 250/492.3 |
| 2007/0228304 | A1 * | 10/2007 | Nishiuchi et al. | 250/505.1 |

(Continued)

FOREIGN PATENT DOCUMENTS

| | | | |
|---|---|---|---|
| EP | 2 687 262 | A1 | 1/2014 |
| JP | 2008-226740 | A | 9/2008 |

(Continued)

OTHER PUBLICATIONS

Chu et al., "Instrumentation for treatment of cancer using proton and light-ion beams", Review of Scientific Instruments, vol. 64, No. 8 (Aug. 1993), pp. 2074-2093.

(Continued)

*Primary Examiner* — Dylan White
(74) *Attorney, Agent, or Firm* — Mattingly & Malur, PC

(57) ABSTRACT

To reduce the number of steps of generating control pattern data needed for achieving beam irradiation with desired energy in the beam extraction from a synchrotron accelerator, a data generator 41 divides adjusted control pattern data, defines the divided data intervals as data modules, and reuses each of the data modules to generate new control pattern data. For extraction energy level changes, which are characteristic of multi-energy extraction, energy change control pattern data is generated based on the extraction pattern data before an energy level change and the extraction pattern data after the energy level change by using an interpolation function thereby to allow the control pattern data to be automatically generated. Effects of residual magnetic fields are calculated in advance, and then adjustment values that allow for the effects of the residual magnetic fields are incorporated into the control pattern data and operation is controlled.

12 Claims, 16 Drawing Sheets

(56) References Cited

U.S. PATENT DOCUMENTS

| | | | | |
|---|---|---|---|---|
| 2009/0195194 | A1* | 8/2009 | Takayama et al. | 315/503 |
| 2009/0289194 | A1* | 11/2009 | Saito | 250/396 R |
| 2010/0001212 | A1* | 1/2010 | Nishiuchi et al. | 250/492.3 |

FOREIGN PATENT DOCUMENTS

| | | | |
|---|---|---|---|
| JP | 2011-124149 | A | 6/2011 |
| JP | 4873563 | B2 | 12/2011 |

OTHER PUBLICATIONS

Iwata et al., "Multiple-energy operation with extended flattops at HIMAC", Nuclear Instruments and Methods in Physics Research, A624 (2010), pp. 33-38.

Search Report received in corresponding British Application No. GB1320907.7 dated Jun. 27, 2014.

* cited by examiner

FIG. 11A

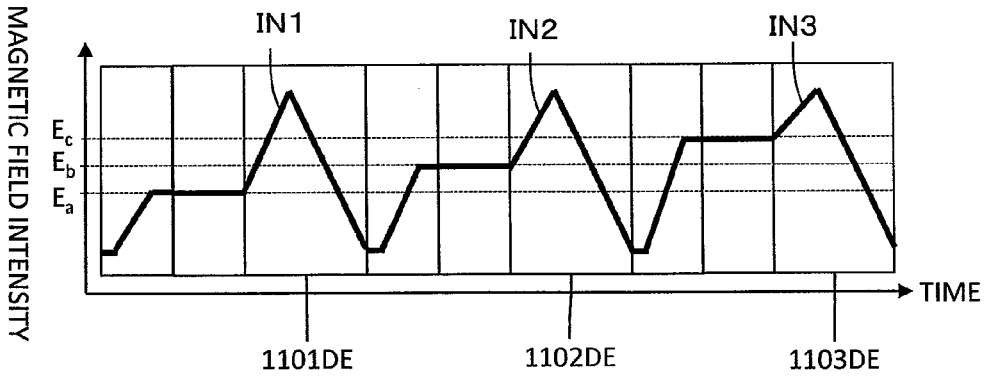

FIG. 11B

| 1ST ENERGY LEVEL | ADJUSTMENT VALUE FOR 1ST LEVEL | ADJUSTMENT VALUE FOR 2ND LEVEL | ··· | ADJUSTMENT VALUE FOR NTH/2ND LEVEL | ··· | ··· | ADJUSTMENT VALUE FOR NTH LEVEL |
|---|---|---|---|---|---|---|---|
| A | X.XXX | X.XXX | ··· | X.XXX | ··· | ··· | X.XXX |
| B | X.XXX | X.XXX | ··· | X.XXX | ··· | ··· | X.XXX |
| C | X.XXX | X.XXX | ··· | X.XXX | ··· | ··· | X.XXX |
| D | X.XXX | X.XXX | ··· | X.XXX | ··· | ··· | X.XXX |
| E | X.XXX | X.XXX | ··· | X.XXX | ··· | ··· | X.XXX |
| F | X.XXX | X.XXX | ··· | X.XXX | ··· | ··· | X.XXX |
| G | X.XXX | X.XXX | ··· | X.XXX | ··· | ··· | X.XXX |

PARTICLE BEAM SYSTEM AND PATTERN DATA GENERATION METHOD FOR PARTICLE BEAM SYSTEM

BACKGROUND OF THE INVENTION

1. Field of the Invention

The present invention relates to particle beam systems suitable for particle beam therapy using such an ionized particle beam (ion beam) as of protons or heavy ions. More particularly, the invention is directed to a particle beam system that accelerates and extracts an ion beam using a synchrotron accelerator, and to a method of generating operation control pattern data used to control devices constituting the synchrotron accelerator.

2. Description of the Related Art

Particle beam therapy, a treatment performed upon the cancer in a patient by irradiating the affected region with such an ion beam as of protons or heavy ions, is known as radiation therapy for cancer. Useable methods for ion beam irradiation include such a scanning irradiation method that is disclosed in REVIEW OF SCIENTIFIC INSTRUMENTS, VOLUME 64, NUMBER 8 (AUGUST 1993), pp. 2074-2093 (hereinafter referred to as Non-Patent Document 1).

In addition, examples of a control method which realizes within a short time the beam energy level change control required in a scanning irradiation method when a synchrotron accelerator is employed as an ionized particle accelerator, include such multi-energy extraction that realizes irradiation of an ion beam of a plurality of energy levels within one operating cycle of an ion synchrotron accelerator, which is disclosed in JP-4873563-B and JP-2011-124149-A as well as Nuclear Instruments and Methods in Physics Research, A624 (2010), pp. 33-38 (hereinafter referred to as Non-Patent Document 2). Unlike the multi-energy extraction, single-energy extraction that realizes irradiation of an ion beam of a single energy level is achieved within one operating cycle of the ion synchrotron accelerator.

SUMMARY OF THE INVENTION

In the scanning irradiation method, irradiation control for the irradiation range (hereinafter, referred to as the layer) in a depth direction of the affected region is implemented by controlling an energy level of the ion beam to be used for irradiation. This makes it necessary in the scanning irradiation method to control the irradiation beam energy according to a particular size of the affected region, and hence to control a combination of irradiation beam energy levels appropriately for each patient who is to be subjected to irradiation or for each affected region that is to be irradiated.

When a synchrotron accelerator is adopted as the ionized particle accelerator, successive operation sessions of injection, acceleration, extraction, and deceleration are controlled as one operating cycle. A large number of sets of pattern data are needed in this case to enable pattern formation of affected regions of various sizes. In addition, the successive operation sessions of injection, acceleration, extraction, energy change, extraction, energy change, . . . and deceleration are controlled as one operating cycle in the multi-energy extraction described in JP-4873563-B and JP-2011-124149-A and Non-Patent Document 2. Energy changes and extraction are repeated as often as there actually are layers, and energy levels as well as the number of repetition of energy extraction also vary from patient to patient or from one affected region to another. For these reasons, multi-energy extraction requires an even larger number of sets of pattern data than single-energy extraction does.

In particle beam therapy systems, particle beam energy adjustment is realized by adjusting electric current values of each device constituting the synchrotron accelerator. When a plurality of sets of control pattern data are necessary, therefore, in order to generate each of the control pattern data sets, the current values of the devices associated with generation of control pattern data need to be adjusted independently for each thereof as well as for each device, and recorded as control pattern data. Adjustment of the control pattern data itself is also required with each insignificant shift in a position of the synchrotron accelerator and periphery thereof due to vibration or other events. As a result, the generation of control pattern data has traditionally required an extremely large number of steps and a very great deal of time, so it has been a problem how to reduce the number of steps needed to generate a plurality of sets of control pattern data.

An object of the present invention is to provide a particle beam system and a method of generating control pattern data that enable reduction in the number of steps of generating control pattern data needed for achieving beam irradiation with desired energy in the beam extraction from a synchrotron accelerator.

A particle beam system according to an aspect of the present invention to attain the above object includes a data generator, the data generator being configured to divide existing adjusted control pattern data, define the divided data intervals as adjusted data modules, and reuse each of the adjusted data modules to generate new control pattern data.

For extraction energy level changes, which are characteristic of multi-energy extraction, energy change control pattern data is generated based on the extraction pattern data before an energy level change and the extraction pattern data after the energy level change by using an interpolation function thereby to allow the control pattern data to be automatically generated. Since multi-energy extraction is affected by pre-extraction residual magnetic fields, the effects of the residual magnetic fields are calculated in advance, and then adjustment values that allow for the effects of the residual magnetic fields is incorporated into the control pattern data and operation is controlled. During creation of the adjustment values allowing for the effects of the residual magnetic fields, part of the adjustment values is created from measurement results on the residual magnetic fields, and the remainder is created by interpolation.

In the present invention, new control pattern data can be automatically generated by the division/reuse of existing adjusted control pattern data, and to obtain multi-energy extraction pattern data, energy change control pattern data can be automatically generated by use of the interpolation function. Additionally, the new control pattern data that has been generated by reusing the adjusted control pattern data requires no readjustment. These characteristics allow reduction in the number of steps involved in the generation of control pattern data.

BRIEF DESCRIPTION OF THE DRAWINGS

FIG. 11A is an explanatory diagram that illustrates residual magnetic field adjustment during conventional single-energy extraction;

FIG. 11B is a diagram showing a chart (table) of adjustment values used for the residual magnetic field adjustment in that embodiment of the present invention which generates control pattern data for multi-energy extraction;

DESCRIPTION OF PREFERRED EMBODIMENTS

Hereunder, embodiments of the present invention will be described using the accompanying drawings.

Figure 1:
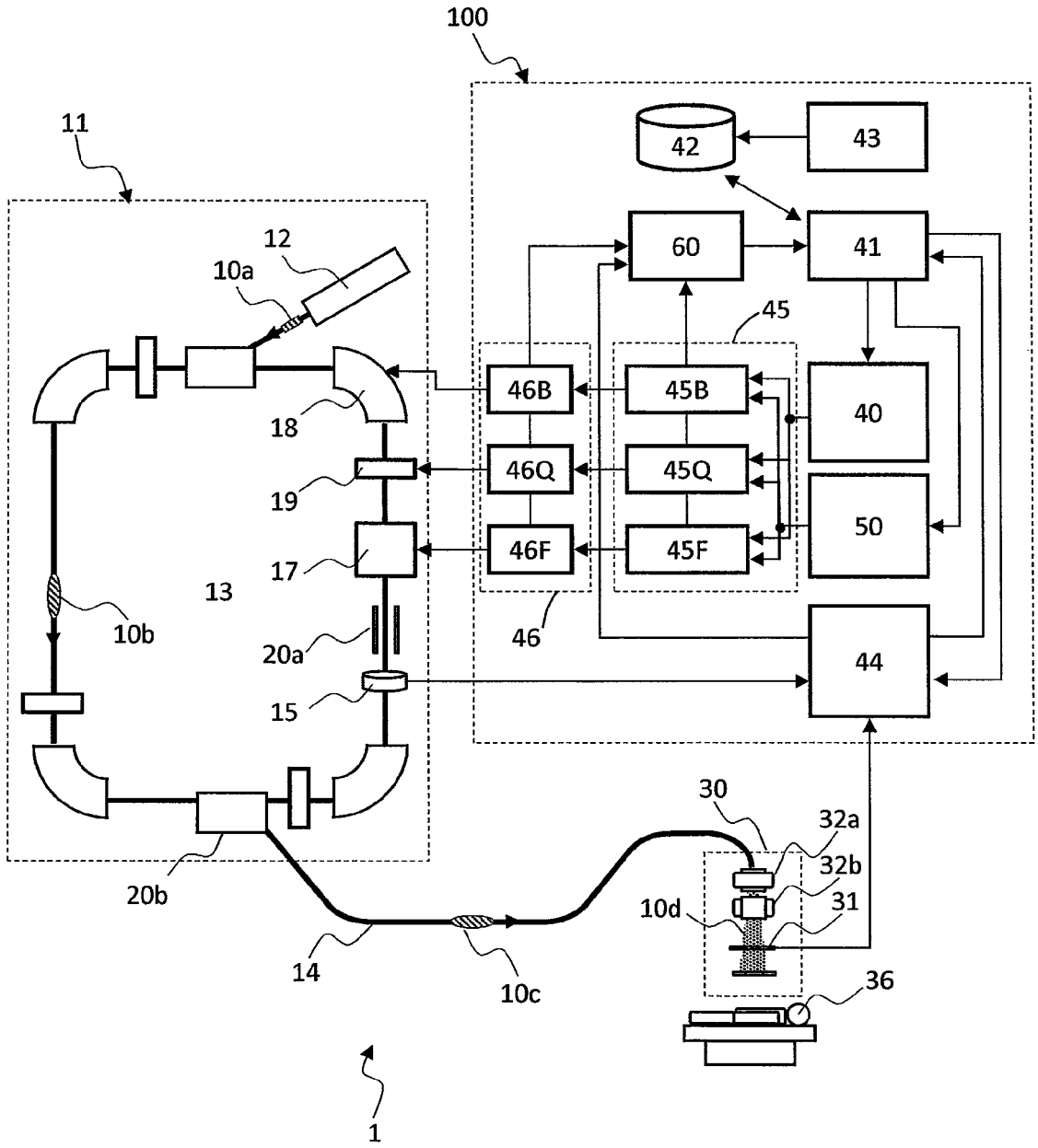
FIG. 1 is a diagram showing a configuration of a particle beam system according to an embodiment of the present invention.

FIG. 1 is a diagram showing a configuration of a particle beam system according to a preferred embodiment of the present invention.

As shown in FIG. 1, the particle beam system 1 according to the present embodiment includes an ionized particle accelerator 11, a beam transport device 14, and an irradiation field forming device (an ionized-particle beam irradiation device; hereinafter, referred to simply as the irradiation device) 30. The beam transport device 14 provides communication between the ionized particle accelerator 11 and the irradiation device 30 placed inside a treatment room.

The ionized particle accelerator 11 includes an ion source (not shown), a pre-accelerator 12, and a synchrotron accelerator 13. The ion source is connected to the pre-accelerator 12, and the pre-accelerator 12 is connected to the synchrotron accelerator 13. The pre-accelerator 12 accelerates an ion beam 10, which has been generated by the ion source, to an energy level at which the ion beam can be transferred to the synchrotron accelerator 13. The ion beam, after being accelerated by the pre-accelerator 12, is transferred to the synchrotron accelerator 13 as an ion beam 10*a*.

The synchrotron accelerator 13 includes a radio-frequency accelerator (RF cavity) 17 that accelerates an orbiting ion beam 10*b* to a target energy level by applying a radio-frequency voltage to the ion beam 10*b*, extraction radio-frequency electrodes 20*a* that augment betatron vibration amplitude of the orbiting ion beam, and an extraction deflector 20*b* that takes out the ion beam from the orbit.

Energy is applied to the beam 10*b* that has been injected into the synchrotron accelerator 13 by the radio-frequency voltage that has been applied to the RF cavity 17, and this beam is accelerated to the desired energy level. In order that the orbit of the ion beam 10*b* moving about inside the synchrotron accelerator 13 becomes constant during the application of the energy, magnetic field intensity of bending magnets 18, quadruple magnets 19, and other devices, and a frequency of the high-frequency voltage applied to the RF cavity 17 are enhanced according to the particular increase in the orbiting energy of the ion beam 10*b*.

The ion beam 10*b* that has been accelerated to the desired energy level is subjected to extraction parameter setting control, by which the amounts of excitation of the quadruple magnets 19 and hexapole magnets (not shown) are then controlled to establish parameters for permitting the orbiting beam 10*b* to be extracted (orbiting beam stabilization limiting parameters). After completion of the extraction parameter setting control, an extraction radio-frequency voltage is applied to the extraction radio-frequency electrodes 20*a* to augment the betatron vibration amplitude of the beam 10*b* orbiting inside the synchrotron accelerator 13. Because of the augmentation of the betatron vibration amplitude, the orbiting beam 10*b* that has exceeded the stabilization limiting parameters is extracted from the synchrotron accelerator 13 and directed to the beam transport device 14, and then the beam is transported to the irradiation device 30. The beam extraction from the synchrotron accelerator 13 can be rapidly achieved by conducting ON/OFF control of the radio-frequency voltage applied to the extraction radio-frequency electrodes 20*a*.

After completion of the beam extraction from the synchrotron accelerator 13, the amounts of excitation of the quadruple magnets 19 and hexapole magnets (not shown) are controlled by extraction parameter cancellation control, to cancel the stabilization limiting parameters of the orbiting beam 10*b* formed during extraction parameter setting.

Upon completion of extraction parameter cancellation control, the magnetic field intensity of the bending magnets 18, quadruple magnets 19, and other devices, and the frequency of the high-frequency voltage applied to the RF cavity 17 are lowered to decelerate the ion beam 10*b* orbiting inside the synchrotron accelerator 13, and shift the synchrotron accelerator 13 to next operating cycle.

In accordance with a depth of an affected region from a body surface of a patient 36 and a shape of the affected region, the irradiation device 30 controls an ion beam 10*c* that has been guided by the beam transport device 14, and irradiates the affected region 37 of the patient 36 on a treatment couch. Scanning irradiation (shown in Non-Patent Document 1, page 2086, FIG. 45) is available as a method of irradiation, and the irradiation device 30 employs the scanning irradiation method. Since the affected region 37 is directly irradiated with an ion beam 10*d*, the scanning irradiation method features high utilization efficiency of the ion beam 10*d* and hence, irradiation with the ion beam 10*d* that better matches the shape of the affected region than a conventional passive irradiation method.

The adjustment of the beam range in a depth direction of the affected region is performed by changing the energy level of the ion beam, thereby to realize desired irradiation of the affected region. Particularly in the scanning irradiation method, the energy of the ion beam 10*b* orbiting inside the synchrotron accelerator 13 is controlled prior to extraction to adjust the beam range to the depth of the affected region 37. Therefore, control of the energy level change is required to be repeated a plurality of times during irradiation therapy of the patient. In addition, spot scanning irradiation, raster scanning irradiation, and the like are available as methods of beam irradiation in a planar direction of the affected region.

In the spot scanning irradiation method, a plane of the affected region to be irradiated is divided into dose management regions called spots, then after beam irradiation of each spot has been continued to obtain an irradiation dose set up with scanning stopped, the beam itself is also turned off, and the irradiation target position is moved to the next spot to be irradiated. In this manner, the starting position of irradiation is updated for each spot in the spot scanning irradiation method.

In the raster scanning irradiation method, although dose management regions are set up as in spot scanning irradiation, beam scanning is not stopped for each spot. Instead, the beam is scanned along the scan route during irradiation. For this reason, the irradiation dose per irradiating operation is reduced and repaint irradiation in which irradiation is repeated a plurality of times is executed for raised uniformity of the irradiation dose. In this manner, the starting position of the irradiation is updated for each scan route in the raster scanning irradiation method. In the spot scanning method, as in the raster scanning irradiation method, the irradiation dose to be delivered during one irradiating operation for one spot position may be set to be low and the plane to be irradiated may be scanned a plurality of times for a final irradiation dose to be reached.

Figure 2:
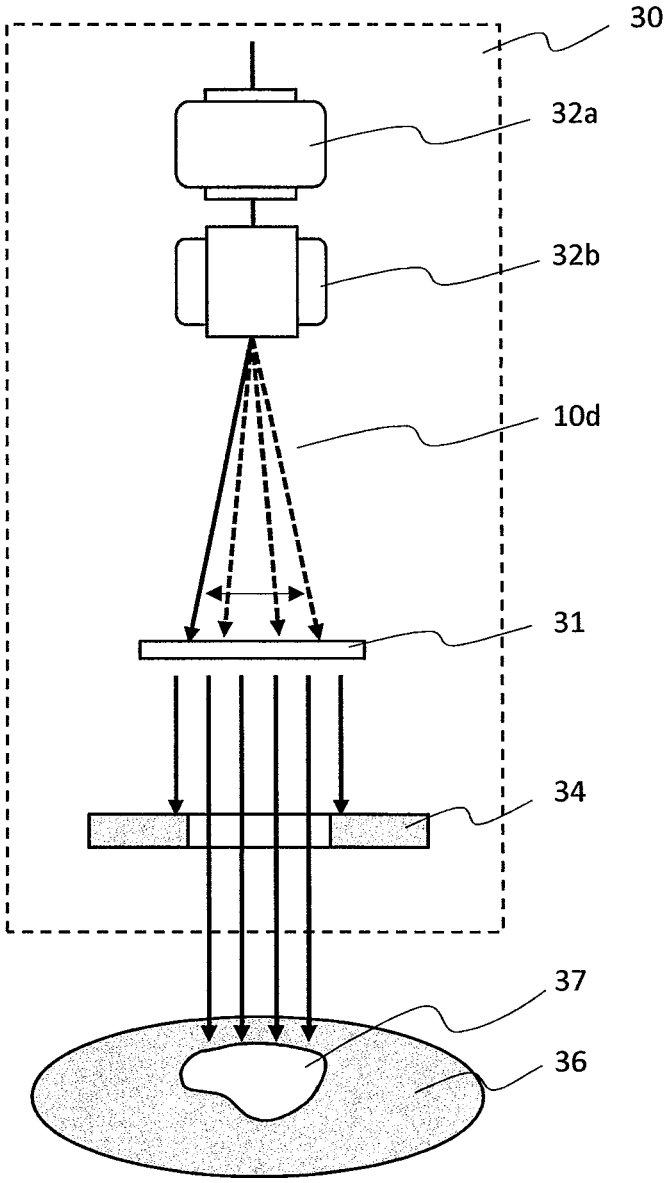
FIG. 2 is a diagram showing a configuration of a scanning irradiation device employed in the embodiment of the present invention.

FIG. 2 shows a configuration of the irradiation device. The irradiation device 30 includes scanning magnets 32*a* and 32*b*, and scans the beam along the plane of the affected region according to the shape of the affected region. The irradiation device 30 also includes a dose monitor 31 that measures the irradiation dose of the beam 10*d* with which the patient is to be irradiated, and a beam shape monitor (not shown), and dose intensity and a shape of the beam 10*d* that has been irradiated are sequentially confirmed using the dose monitor 31 and the beam shape monitor. After being scanned by the scanning magnets 32, the beam 10*d* forms an irradiation field via a collimator 34, the irradiation field fitting the particular shape of the affected region 37 of the patient 36.

Referring back to FIG. 1, the particle beam system 1 according to the present embodiment includes a control system 100 (controllers). The control system 100 includes an accelerator controller 40 that controls the ionized particle accelerator 11 and the beam transport device 14, a main controller 41 that conducts total control of the entire particle beam system 1, a treatment planning device 43 that creates conditions for irradiating the patient with an ion beam, a data storage device 42 for storage of the information that the treatment planning device 43 has planned, control information on the synchrotron accelerator 13, which is the ionized particle accelerator, and on the beam transport device 14, and other information, an irradiation controller 44 that controls the constituent elements of the irradiation device 30 and the irradiation dose of the ion beam 10*d* delivered to the affected region 37, a timing system 50 that implements synchronous control of the devices constituting the synchrotron accelerator 13, an interlock system 60 that is constructed independently of the main controller 41 so as to ensure safety for the patient 36, and a power supply controller 45 that controls a power supply 46 provided for each of the constituent devices of the synchrotron accelerator 13. The main controller 41 may include the storage device 42 as a part thereof.

The power supply 46 is a name referring collectively to power supplies for the plurality of devices constituting the synchrotron accelerator 13. A power supply 46B for each bending magnet 18, a power supply 46Q for each quadruple magnet 19, and a power supply 46F for the RF cavity 17 are shown in FIG. 1 as the power supplies for the plurality of devices. The power supply controller 45 is likewise a name referring collectively to power supplies for the plurality of controllers corresponding to the plurality of devices. A controller 45B for the power supply 46B, a controller 45Q for the power supply 46Q, and a controller 45F for the power supply 46F are shown in FIG. 1.

The main controller 41 also operates as the data generator characterizing the present invention. The data generator automatically generates the control pattern data for the bending magnets 18 and other devices of the synchrotron accelerator 13. In the present embodiment, the control system 100 is constructed to conduct the multi-energy extraction control that enables an ion beam of a plurality of energy levels to be extracted within one operating cycle of the synchrotron accelerator 13. The data generator (main controller 41) automatically generates the pattern data used for the multi-energy extraction control.

Figure 8:
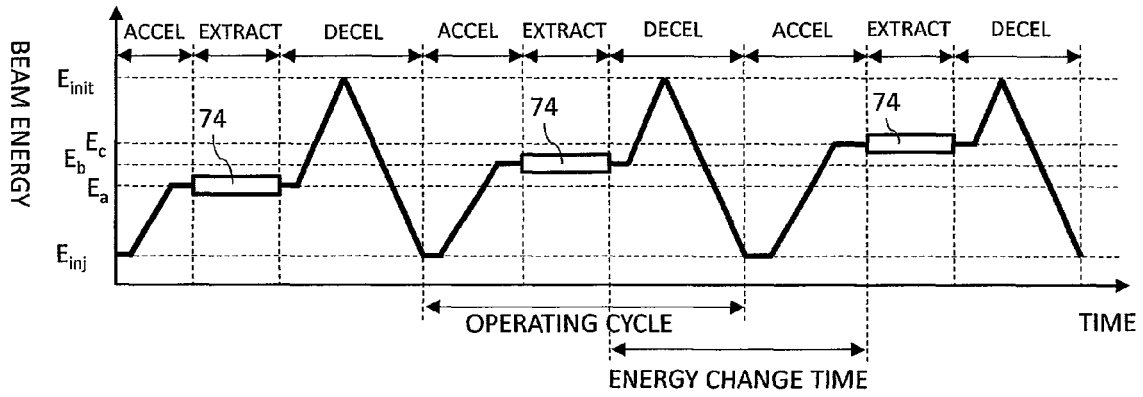
FIG. 8 is a diagram showing an operating sequence of a conventional synchrotron accelerator.

Superiority of the multi-energy extraction control using the pattern data generated in an embodiment of the present invention is described below. FIG. 8 shows an operating sequence of a conventional synchrotron accelerator 13. The synchrotron accelerator 13 conducts a control sequence of acceleration, extraction, and deceleration, within one operating cycle. Before and after the extraction, extraction parameter setting and extraction parameter cancellation are required. More specifically, extraction parameter setting control is required for the extraction of the ion beam inside the synchrotron accelerator, and extraction parameter cancellation control is required after extraction control.

In the operation control of the conventional synchrotron accelerator 13, the control data geared to the control sequence is provided as pattern data in a memory of a power supply controller 45 and the power supply controller 45 updates the control data in accordance with a timing signal 51 that is output from a timing system 50 which manages control timing of the devices constituting the synchrotron accelerator 13.

As shown in FIG. 8, the synchrotron accelerator 13 performs control from acceleration to deceleration within one operating cycle. To change the energy of the ion beam 10*c* to be extracted, therefore, the synchrotron accelerator needs to shift to deceleration control upon completion of extraction control, and then after decelerating a residual beam, update the operating cycle. The synchrotron accelerator achieves change control for a desired energy level by updating the operating cycle and then once again accelerating the ion beam 10*b*. The operation control of the conventional synchrotron accelerator 13, therefore, poses a problem in that since the energy level change of the ion beam 10*b* requires substantially the same deal of time as one operating cycle, a treatment time tends to increase, which is liable to hinder the improvement of a dose rate.

Multi-energy extraction control of an ion synchrotron accelerator for realizing the extraction of ion beams of multiple energy levels within one operating cycle is introduced in JP-4873563-B. Such multi-energy extraction control enables an energy level change time to be reduced in the scanning irradiation method.

Figure 3:
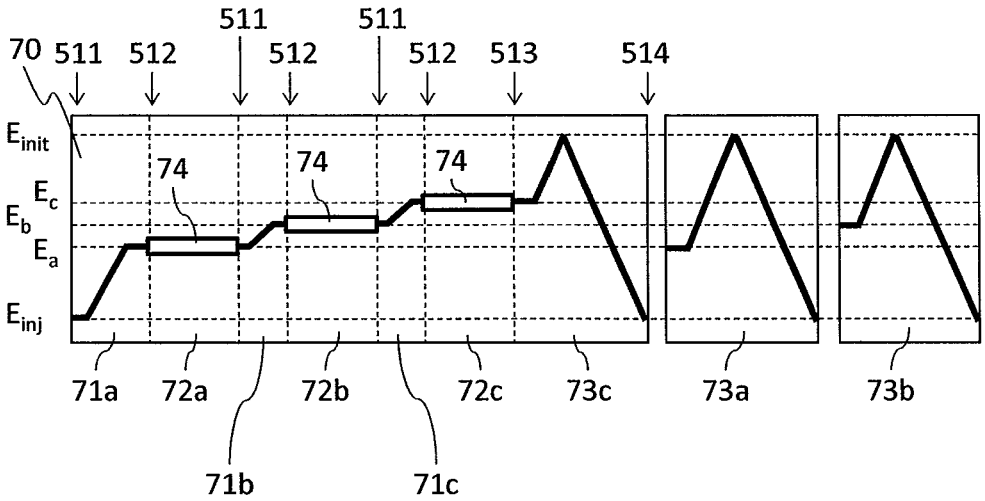
FIG. 3 is a diagram that shows composition of control data used in the embodiment of the present invention.

Non-Patent Document 2 describes an operating method in which stepwise control data including energy change control and extraction control is provided in advance to suit a plurality of energy levels of beams to be extracted from an ion synchrotron accelerator (see Non-Patent Document 2, page 34, FIG. 2) and a flat section of the control data of the extraction control section corresponding to the energy level of the ion beam to be extracted is extended (see Non-Patent Document 2, page 35, FIG. 3).

As described in Non-Patent Document 2, when the control in which the control data enabling the plurality of energy levels of the beams to be extracted is provided in advance is applied, if the quantity of ion beams needed to complete all irradiating operations remains in the synchrotron accelerator, this is effective since the irradiation with the beams of all the energy levels can be completed within one operating cycle. If the quantity of ion beams needed to complete all irradiating operations does not remain in the synchrotron accelerator, however, it is necessary, after the execution of deceleration control upon exhaustion of the ion beams, to update the operating cycle and then execute the injection and acceleration of the ion beam 10*b* once again. At this time, shifting the synchrotron accelerator from extraction control of the energy of the exhausted ion beams to deceleration control thereof requires consideration of the continuity of the control data, and in turn requires updating of all the energy change control data stored in a location posterior to that of the data relating to the energy of the exhausted ion beam 10*b*. For these reasons, operation cannot be directly shifted from the control data to deceleration control. Accordingly, it becomes a time-consuming task to update the operating cycle of the synchrotron accelerator 13. If trouble occurs in a device constituting the particle beam system 1, this likewise does not enable direct shifting from the control data to deceleration control.

JP-2011-124149-A presents a controller for an accelerator equipped with hardware elements that supply information relating to a coil current needed to energize magnetic field coils of the accelerator. The hardware elements are a magnetic field reference generator which outputs appropriate magnetic-flux density information according to an elapsed time, and a reference current converter which calculates the coil current for generating a magnetic field appropriate for the magnetic-flux density information. JP-2011-124149-A also shows a control method in which the magnetic field reference generator achieves beam extraction of a plurality of energy levels within one operating cycle by generating an output of the magnetic-flux density information in a combination of four kinds of patterns (an initial boost pattern, a decremental pattern, an incremental pattern, and an ending pattern). According to JP-2011-124149-A, ion beams of a plurality of energy levels can be extracted within one operating cycle by combining the four kinds of magnetic-flux density patterns. At the same time, however, since the reference current converter sequentially outputs the excitation currents of the bending magnets and quadruple magnets while sequentially calculating these currents, a need arises to change arithmetic parameter settings with each pattern change and as a result, the device configuration and the control means are likely to become complex. In addition, neither Non-Patent Document 2 nor JP-2011-124149-A gives no description of the problem that it takes a great deal of time to update the operating cycle of the synchrotron accelerator in Non-Patent Document 2.

The present invention relates to the multi-energy extraction control of an ion synchrotron accelerator that enables it to extract ion beams of a plurality of energy levels within one operating cycle of the synchrotron accelerator. The invention provides the ion synchrotron accelerator in which the change control of the beam energy and the updating of the operating cycle can be achieved within a short time for the multi-energy extraction operation using the control pattern data for multi-energy extraction, generated in the invention. The following describes details of the synchrotron accelerator.

First, a data structure of the pattern data for multi-energy extraction according to the present embodiment, and an operation sequence using the control pattern data are described below using FIGS. 3 to 7A and 7B.

FIG. 3 is a diagram that shows composition of the control data (control pattern data) relating to the devices constituting the synchrotron accelerator, the diagram also showing the excitation current of the bending magnets 18 as a typical example of the control data relating to the devices. In actuality, as shown in Non-Patent Document 2, data of the number of levels corresponding to the number of energy levels of the irradiation beams is provided, but the data described in the present embodiment is of three levels. In addition, while the control data that gives rise to sequential beam irradiation from lower energy levels to higher ones is shown in the present embodiment, substantially the same effects can also be obtained from sequential beam irradiation from higher energy levels to lower ones.

Figure 4:
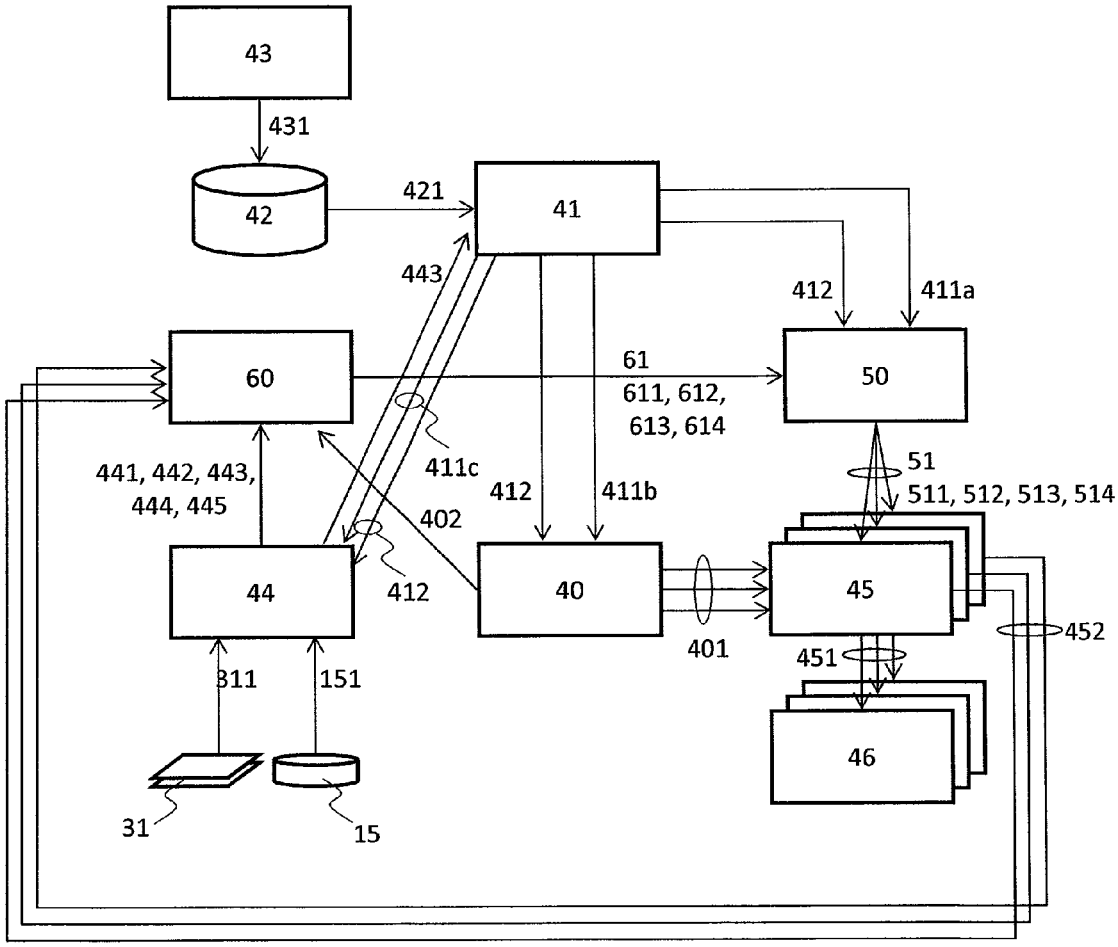
FIG. 4 is a diagram showing a flow of data transmission between controllers in the embodiment of the present invention.
Figure 5:
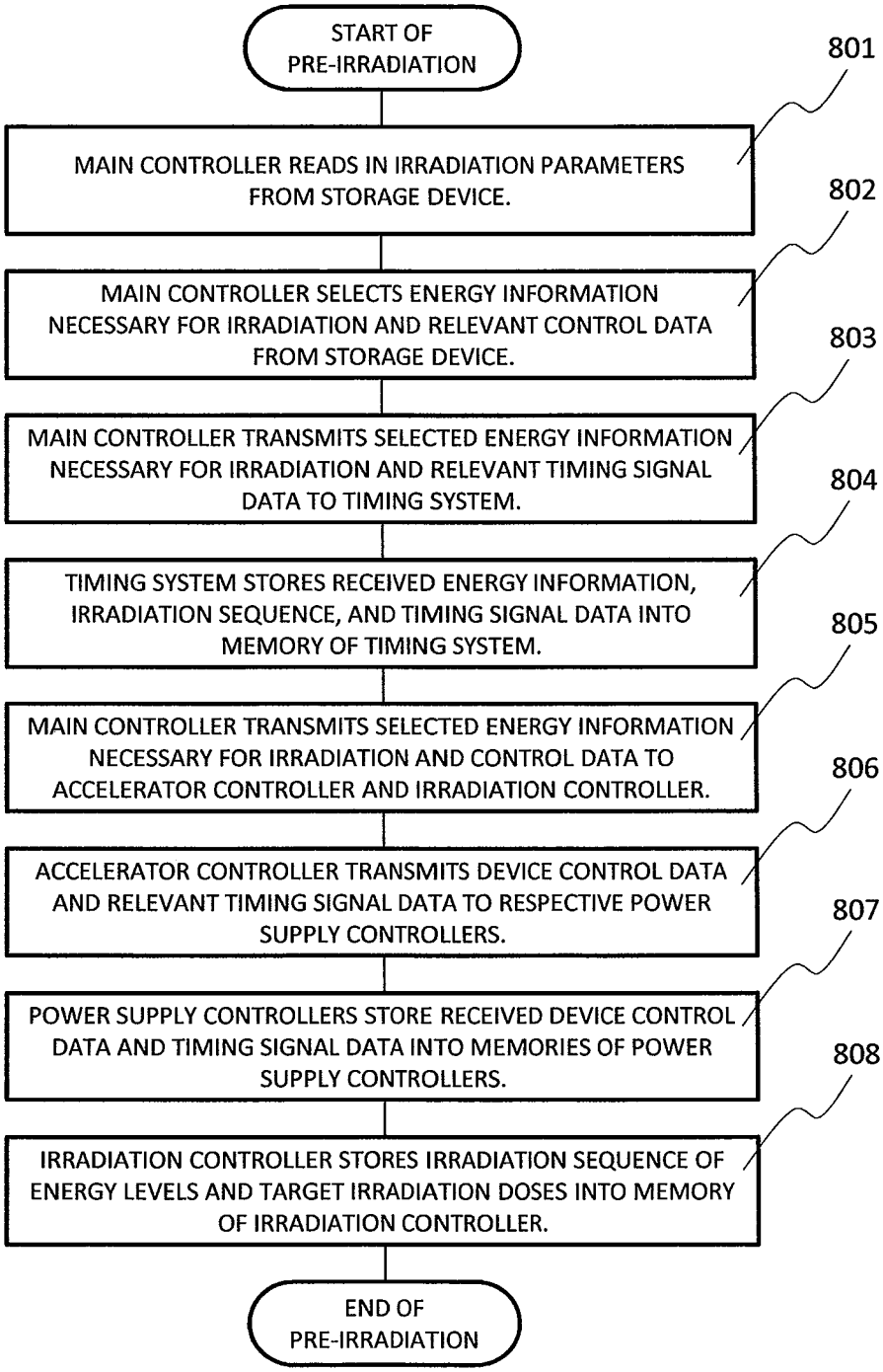
FIG. 5 is a diagram showing a process flow of pre-irradiation for multi-energy extraction in the embodiment of the present invention.
Figure 6:
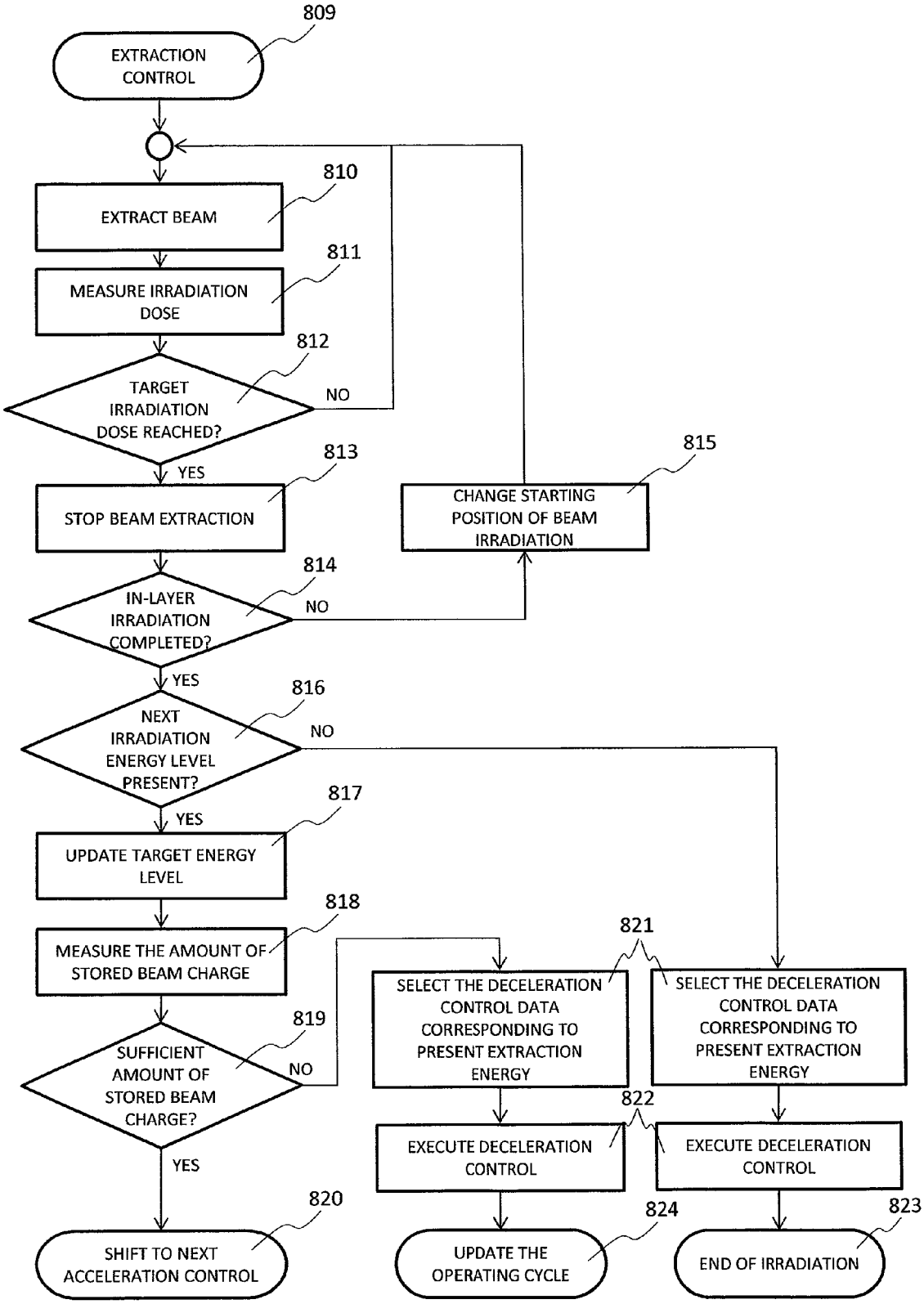
FIG. 6 is a diagram showing a process flow of operation control for the multi-energy extraction in the embodiment of the present invention.
Figure 7A:
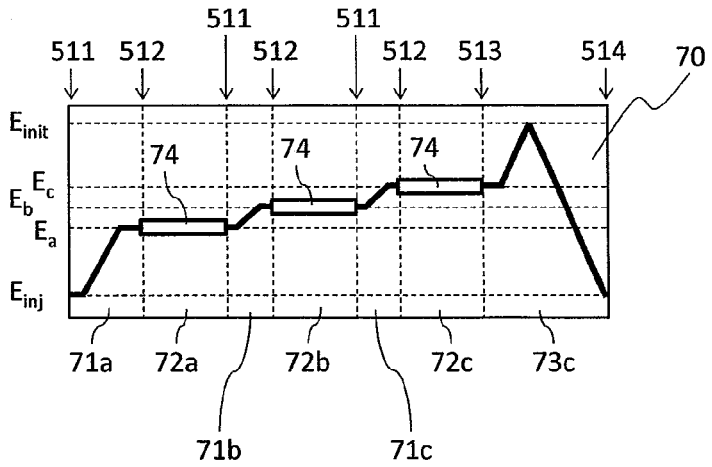
FIG. 7A is a diagram showing an example of control data output during the multi-energy extraction in the embodiment of the present invention.
Figure 7B:
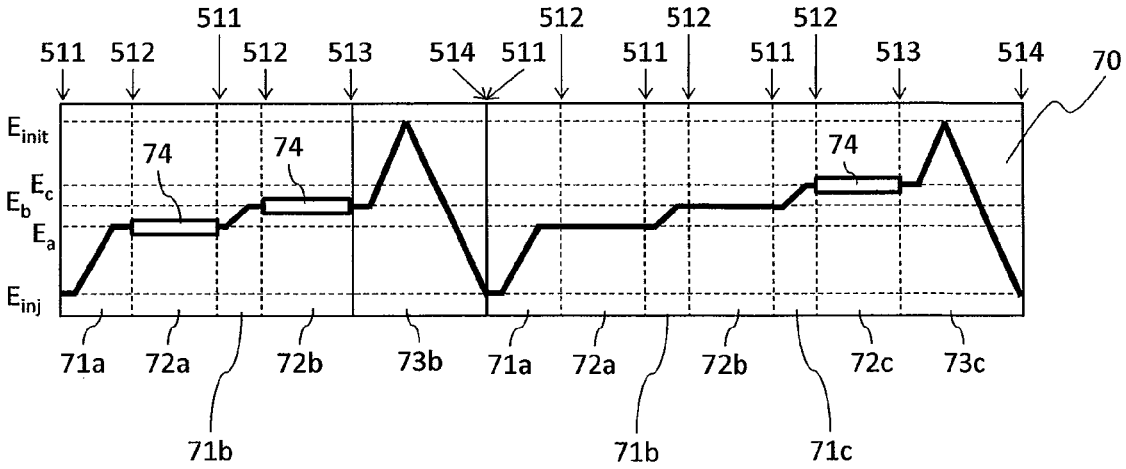
FIG. 7B is a diagram showing another example of control data output during the multi-energy extraction in the embodiment of the present invention.

FIG. 4 is a diagram showing a configuration of the control system 100 (controllers) for achieving the multi-energy extraction control that characterizes the present embodiment. A flow of information transmission between the controllers is also shown in FIG. 4. FIG. 5 is a diagram showing a process flow of pre-irradiation conducted before the multi-energy extraction control is started. FIG. 6 is a diagram showing a process flow of the multi-energy extraction control. FIGS. 7A and 7B show examples of control data output during the multi-energy extraction control that uses combinations of the control data shown in FIG. 3.

As shown in FIG. 3, the control data on the plurality of devices constituting the synchrotron accelerator (in the shown example, the bending magnets 18) includes multi-energy extraction pattern data 70, which is used to control the extraction of the beams of a plurality of energy levels within one operating cycle, and a plurality of sets of deceleration control data 73*a* and 73*b* corresponding to extraction control of the beams of the energy levels. Extraction control of the beams of the plurality of energy levels is conducted by controlling the relevant devices (in the shown example, the bending magnets 18) by use of the multi-energy extraction pattern data 70. In addition, the plurality of sets of deceleration control data 73*a* and 73*b* corresponding to extraction control of the beams of the energy levels are provided, which enables rapid shifting to deceleration control from whatever energy level.

The multi-energy extraction pattern data 70 includes a plurality of sets of acceleration control data (acceleration control sections) 71*a* to 71*c* (hereinafter, represented as 71 where appropriate), a plurality of sets of extraction control data (extraction control sections) 72*a* to 72*c* (hereinafter, represented as 72 where appropriate), and deceleration control data (deceleration control section) 73*c* (hereinafter, represented as 73 where appropriate). Additionally, a plurality of sets of deceleration control data 73*a* and 73*b* (hereinafter, represented as 73 where appropriate) are provided for the plurality of sets of extraction control data constituting a part of the multi-energy extraction pattern data 70. The control data sets 71 to 73 are each provided as time-series data on a current/voltage which is a control quantity assigned directly to the relevant device. The control data relating to the bending magnets 18, for example, includes time-series data on the excitation current and voltage (not shown) that are set up for the bending magnet power supply 46B needed to generate predetermined bending magnetic field intensity. A plurality of sets of pattern data that are formed from different combinations of irradiation energy levels, for irradiation parameters relating to an assumed plurality of patients, are provided as the pattern data 70 for achieving the multi-energy extraction control, and these sets of pattern data 70, along with the relevant sets of deceleration control data 73, are prestored within the storage device 42. The control pattern data for multi-energy extraction that includes the multi-energy extraction pattern data 70 and deceleration control data sets 73*a*, 73*b* shown in FIG. 3 is the control data that has been stored in the storage device 42, then selected therefrom according to the irradiation parameters for a specific patient, and stored into the power supply controller 45.

The multi-energy extraction pattern data 70 may include the acceleration control section 71 and the extraction control section 72, and the deceleration control data 73 may be constructed so that each set of deceleration control data corresponding to all beam energy levels that can be extracted from the synchrotron accelerator and that satisfy the irradiation parameters for the assumed plurality of patients is integrated as one set of deceleration control data 73. In this case, if all multi-energy extraction pattern data 70 corresponding to the irradiation parameters for the assumed plurality of patients is prestored into the storage device 42 and all deceleration control data 73 is prestored into the power supply controller 45, only the multi-energy extraction pattern data 70 relevant to the irradiation parameters for the patients may be sequentially selected from the storage device 42 and the selected pattern data may be stored into the power supply controller 45. This enables irradiation and thereby facilitates management of the control data for each irradiating operation on the patients. Additionally, if the deceleration control data 73 is prestored into the power supply controller 45, a capacity of the control data transmitted between the controllers can be reduced according to the irradiation parameters for each patient. The above also enables reduction in the time needed to update the control data when the pre-irradiation process is conducted.

Furthermore, the control pattern data for multi-energy extraction, prestored within the storage device 42, may be provided as the time-series data denoting the magnetic field intensity inside the synchrotron accelerator. In this case, as the control pattern data is being stored into the power supply controller 45 via the main controller 41 and the accelerator controller 40, the control pattern data in the main controller 41 or the accelerator controller 40 will be converted from the time-series data of the magnetic field intensity into that of the excitation current and voltage and stored into the power supply controller 45 as the time-series data denoting the excitation current and the voltage.

The multi-energy extraction pattern data 70 is associated with a timing signal 51 that is output from the timing system 50 to the power supply controller 45. The timing signal 51 in the present embodiment includes an acceleration timing signal 511, an extraction timing signal 512, a deceleration startup timing signal 513, and a deceleration completion timing signal 514. Upon input of the timing signal 51 to the power supply controller 45, the power supply controller 45 selects the control data set 71 to 73 associated with the timing signal 51, and starts data updating control from an initial address of the selected control data set 71 to 73.

Referring to FIG. 3, when the acceleration timing signal 511 is input, the updating control of the acceleration control data set 71*a* from injection energy (Einj) to extraction energy (Ea) of an initial level is conducted and the beam is accelerated. When the extraction timing signal 512 is input, the updating control of the extraction control data set 72*a* is conducted and an application process 74 for the extraction radio-frequency voltage is conducted upon the extraction radio-frequency electrodes 20*a*. Beam extraction is thus controlled. The irradiation controller 44 sequentially measures the irradiation dose 311 occurring during extraction control, then outputs a planned dose achievement signal 442 in accordance with the measured value and completes extraction control. Depending on the amount of beam charge remaining at the completion of extraction control and on whether next irradiation energy is present, the irradiation controller 44 determines whether the timing system 50 outputs the acceleration timing signal 511 to shift the pattern data to the next acceleration control data (energy change control data), that is, shift the pattern data from 72*a* to 71*b*, or outputs the deceleration startup timing signal 513 to shift the pattern data to the deceleration control data, that is, shift the pattern data from 72*a* to 73*a*. To achieve this control, an ending value of the extraction control data 72 and a starting value of the acceleration control data (energy change control data) 71 for accelerating the beam to the next irradiation energy (e.g., an ending value of 72*a* and a starting value of 71*b* in FIG. 3) are set to be the same value in the multi-energy extraction pattern data 70 so that both values can be continuously connected. The same also applies for the ending value of the extraction control data 72 and a starting value of the deceleration control data 73 for decelerating the beam to injection energy (e.g., the ending value of 72*a* in FIG. 3 and a starting value of 73*a* in the figure). Such control allows the control data to be easily changed and updated according to the input of the timing signal 51.

In addition, when the multi-energy extraction control described above is executed, the interlock system 60 outputs an interlock signal 61 based on an energy change request signal 443, a deceleration request signal 444, and an irradiation completion signal 445, each output from the irradiation controller 44, and on status information 452 output from the power supply controller 45, to indicate whether the relevant devices are sound. The interlock signal 61 includes an energy change command 611, an irradiation completion command 612, and a deceleration command 613. The timing system 50 outputs the acceleration timing signal 511 in accordance with the energy change command 611 output from the interlock system 60. The timing system 50 also outputs the deceleration startup timing signal 513 in accordance with the irradiation completion command 612 and the deceleration command 613. In accordance with the acceleration timing signal 511, the power supply controller 45 conducts the updating control of the acceleration control data (energy change control data) 71 included in the multi-energy extraction pattern data 70, and in accordance with the deceleration startup timing signal 513, the power supply controller 45 selects, among the deceleration control data sets 73*a*, 73*b*, 73*c*, only the deceleration control data corresponding to immediately previous extraction energy, and conducts the updating control of the selected deceleration control data.

The process flow of the pre-irradiation for executing the multi-energy extraction control by use of the control data of FIG. 3 that relates to the devices constituting the synchrotron accelerator is described below using FIGS. 4 and 5 together.

First, the treatment planning device 43 registers, in the storage device 42, treatment planning information 431 containing the irradiation parameters and others required for the treatment of the patient. In step 801, on the basis of the irradiation parameter setting information, the main controller 41 reads in the irradiation parameters 421 from the storage device 42. In step 802, the main controller 41 selects the following five kinds of information from the irradiation parameters 421: (a) the energy information necessary for irradiation, (b) target irradiation doses, (c) an irradiation sequence, (d) multi-energy extraction pattern data corresponding to the irradiation energy, and (e) deceleration control data if prestored within the storage device 42.

In step 803, the main controller 41 transmits timing signal data 411*a* including the energy information necessary for irradiation, the irradiation sequence, and timing signals corresponding to the energy information, to the timing system 50.

In step 804, the timing system 50 stores the timing signal data 411*a* transmitted from the main controller 41 and including the energy information, the irradiation sequence, and the timing signals corresponding to the energy information, into an internal memory of the timing system 50. In step 805, the main controller 41 likewise transmits control data sets 411*b* and 411*c* including the energy information necessary for irradiation, the irradiation sequence, and the timing signals corresponding to the energy information, to the accelerator controller 40 and the irradiation controller 44, respectively. The control data set 411*c* transmitted to the irradiation controller 44 includes the irradiation sequence of each irradiation energy level, and the target irradiation doses.

In step 806, the accelerator controller 40 transmits control data 401 to each power supply controller 45 for each of the constituent devices of the synchrotron accelerator 13 and beam transport device 14, the control data 401 including the control pattern data for each device and the timing signals corresponding to the control pattern data. In step 807, the power supply controller 45 stores the control data 401 into the memory. In step 808, the irradiation controller 44 stores the irradiation sequence of the irradiation energy levels and the target irradiation doses into an internal memory.

Next, the process flow of the beam extraction control conducted when multi-energy extraction is controlled using the control data of FIG. 3 that relates to the devices constituting the synchrotron accelerator is described below using FIGS. 4 and 6.

The power supply controller 45 uses the acceleration control data 71*a* to accelerate the beam from the injection energy level (Einj) to the extraction energy level (Ea), and the accelerator controller 40, after confirming the energy of the orbiting beam 10*b*, outputs an energy determination signal 402 to the interlock system 60. In step 809, the interlock system 60 outputs an extraction command 614 to the timing system 50 to shift operation control to extraction control. In extraction control, the radio-frequency signal application process 74 is conducted upon the extraction radio-frequency electrodes 20*a* in accordance with an extraction permission signal 441 from the irradiation controller 44. The beam is thus extracted (step 810). During extraction control of the beam, the irradiation controller 44 uses the dose monitor 31 to measure the dose 311 delivered to the affected region (step 811), and sequentially determines whether the irradiation dose 311 has reached its target value, that is, whether irradiation target dosing has been completed (step 812). The target dose here refers to a dose to be applied to one spot position in one irradiating operation in the case of spot scanning, or a dose to be applied when a scan route is irradiated once in the case of raster scanning. Upon the irradiation dose 311 being reached, the radio-frequency voltage application process 74 for the extraction radio-frequency electrodes 20*a* is stopped and then beam extraction control is stopped (step 813). After this, the irradiation controller 44 confirms whether the irradiation inside the layer is completed (step 814). If the irradiation inside the layer is not completed, a starting position of the beam irradiation is changed (step 815) and beam control is continued. The irradiation controller 44 determines whether next irradiation data exists (step 816). If the next irradiation data does not exist, the irradiation controller 44 outputs the irradiation completion signal 445 to the interlock system 60. The interlock system 60 then outputs the irradiation completion command 612 to the timing system 50. The timing system 50 outputs the deceleration startup timing signal 513, and the power supply controller 45 selects the deceleration control data corresponding to the present extraction energy (step 821) and after executing deceleration control (step 822), completes irradiation control (step 823).

Conversely if the next irradiation data exists, after updating a target energy level in step 817, the irradiation controller 44 uses a remaining-beam quantity monitoring method 15 to measure in step 818 the amount of beam charge 151 remaining in the synchrotron accelerator and determine in step 819 whether the amount of remaining beam charge 151 suffices for the irradiation with the beam of the next energy level. If the amount of remaining beam charge 151 suffices for the next beam irradiation, the irradiation controller 44 outputs the energy change request signal 443 to the interlock system 60. The interlock system 60 then outputs the energy change command 611 to the timing system 50. The timing system 50 outputs the acceleration timing signal 511, and the power supply controller 45 selects the acceleration control data corresponding to the present extraction energy and shifts to beam acceleration control for the next irradiation energy level (step 820).

Conversely if the amount of remaining beam charge is determined to be insufficient, the irradiation controller 44 outputs the deceleration request signal 444 to the interlock system 60. The interlock system 60 then outputs the deceleration command 613 to the timing system 50. The timing system 50 outputs the deceleration startup timing signal 513, and the power supply controller 45 selects the deceleration control data corresponding to the present extraction energy (step 821) and executes deceleration control (step 822). After deceleration control, the power supply controller 45 updates the operating cycle (step 824) and continues the beam irradiation. Although this is not clearly indicated in the control process flow diagram of FIG. 6, if any trouble with the power supply controller 45 and the power supply 46 for each of the constituent devices of the synchrotron accelerator occurs during beam extraction control, the status information 452 indicating that either of the devices is abnormal is transmitted from the power supply controller 45 to the interlock system 60. On the basis of the status information 452 indicating the abnormality of the device(s), the interlock system 60 outputs the deceleration command 613 to the timing system 50 and rapidly executes deceleration control using the deceleration control data corresponding to the present extraction energy.

Examples of control data output during the multi-energy extraction control characterizing the present embodiment are shown in FIGS. 7A and 7B. FIGS. 7A and 7B show the examples of output that use the multi-energy extraction pattern data 70 shown in FIG. 3. In the examples, beams of three energy levels, namely Ea, Eb, Ec, can be extracted within one operating cycle. FIG. 7A shows how the excitation current value of each bending magnet will change when extraction control is conducted upon the ion beams of all the three energy levels (Ea, Eb, Ec) within one operating cycle. FIG. 7B shows how the excitation current value of each bending magnet will change when the ion beams of two energy levels (Ea, Eb) are extracted at a first operating cycle and then after a shift to deceleration control has been conducted for a reason such as the exhaustion of the remaining ion beam charge, the operating cycle is updated and the ion beam of the remaining (third) energy level (Ec) is extracted at the next operating cycle. In general, the excitation current value of the bending magnet and the beam energy are nearly proportional, so the changes shown in FIGS. 7A and 7B can also be taken to mean the changes that the beam energy exhibits during the multi-energy extraction control.

In addition, in the scanning irradiation method, since the extraction energy of the beam differs according to operating cycle, the beam is first accelerated to its initial energy (Einit) and then the control is shifted to deceleration control to obtain the injection energy (Einj) so that a history of magnetic fields in the deceleration control data shown in the present embodiment will be kept constant.

First, an example of the output which uses the multi-energy extraction control is described below using FIG. 7A. Upon the acceleration timing signal 511 being output from the timing system 50, the power supply controller 45 selects the acceleration control data 71*a* corresponding to the initial energy level, and starts excitation current data updating control. After completion of acceleration control, the accelerator controller 40 confirms the energy of the orbiting beam 10*b* and outputs the energy determination signal 402 to the interlock system 60. If the reached energy level agrees with the target energy level (in this case, the reached energy level and the target energy level are both Ea), the interlock system 60 outputs the extraction command 614 to the timing system 50. The timing system 50 outputs the extraction timing signal 512 in accordance with the extraction command 614 from the interlock system 60. In accordance with the extraction control timing signal 512, the power supply controller 45 updates the extraction control data 72*a* corresponding to the extraction energy level Ea. Concurrently with this, the irradiation controller 44 outputs the extraction permission signal 441. The application process 74 for the extraction radio-frequency signal is consequently conducted, whereby extraction control of the beam is executed. After the irradiation of the affected region has reached the desired dose as a result of beam extraction control, the irradiation controller 44 turns off the extraction permission signal 441 to stop the extraction radio-frequency signal application process 74.

After the above, the irradiation controller 44 outputs the energy change request signal 443 to the interlock system 60 according to determination results on whether the next irradiation energy is present, and measurement results on the amount of beam charge remaining in the synchrotron accelerator 13. The interlock system 60 outputs the energy change command 611 to the timing system 50, and then the timing system 50 outputs the acceleration timing signal 511 to accelerate the remaining beam to the next energy. In accordance with the acceleration timing signal 511, the power supply controller 45 starts the updating control of the acceleration control data 71*b* corresponding to the extraction energy level Eb. After completion of beam acceleration based on the acceleration control data (energy change control data) 71*b*, the accelerator controller 40 confirms agreement between the target energy level and the reached energy level as in the case of beam extraction control of the initial extraction energy level Ea, and the power supply controller 45 extracts the beam by use of the extraction control data 72*b* corresponding to the extraction energy level Eb.

After completion of extracting the beam of the extraction energy level Ec by repeating such control, the irradiation controller 44 confirms absence of next irradiation energy and transmits the irradiation completion signal 445 to the interlock system 60. The interlock system 60 then transmits to the timing system 50 the irradiation completion command 612 indicating that a next operating cycle to be controlled is absent. The timing system 50 outputs the deceleration startup timing signal 513. The power supply controller 45 shifts to deceleration control in accordance with the deceleration startup timing signal 513. In deceleration control, the deceleration control data 73*c* corresponding to the immediately previous extraction energy level Ec is selected and the updating control of the deceleration control data 73*c* is started. Based on the deceleration control data 73*c*, deceleration control is conducted to decelerate the beam to the injection energy (Einj) after acceleration of the beam to the initial energy (Einit). Thus the history of magnetic fields for each operating cycle is held constant. In timing with the completion of updating of the deceleration control data 73*c*, the timing system 50 outputs the deceleration completion timing signal 514 to complete the irradiation in accordance with the irradiation completion command 612.

Next, a flow of processing in the case that the operating cycle is updated during the multi-energy extraction control, as shown in FIG. 7B, is described below. Reference numbers and symbols shown in the figure denote the same as in FIG. 7A. The following describes the process flow that follows the completion of extraction control of the second energy level Eb shown in FIG. 7B.

After extraction control of the second energy level Eb, the irradiation controller 44 confirms presence of the next irradiation data (step 817) and then measures the amount of beam charge 151 remaining in the synchrotron accelerator. If a result of the measurement indicates that the amount of beam to be next extracted cannot be satisfied, the irradiation controller 44 transmits the deceleration request signal 444 to the interlock system 60. The interlock system 60 then outputs the deceleration command 613 to the timing system 50 in accordance with the deceleration request signal 444. The timing system 50 outputs the deceleration startup timing signal 513 in accordance with the deceleration command 613 that has been input. In accordance with the deceleration startup timing signal 513, the power supply controller 45 selects the deceleration control data 73*b* corresponding to the immediately previous extraction energy Eb, and starts the updating control of the deceleration control data 73*b*.

The timing system 50 outputs the deceleration completion timing signal 514 in timing with the completion of updating of the deceleration control data 73*c*. After this output, because the next irradiation data is present, the target energy is changed from Eb to Ec, then the operating cycle is updated, and the acceleration timing signal 511 is output.

Upon receiving the acceleration timing signal 511, the power supply controller 45 starts the updating control of the acceleration control data 71*a*. After completion of acceleration control, the accelerator controller 40 compares the reached energy level and the target energy level. At this time, the reached energy corresponding to the acceleration control data 71*a* is Ea, but disagreement in extraction energy may occur (Ea≠Ec) since the target energy is Ec. In this case, the irradiation controller 44 leaves the extraction permission signal 441 turned off until the target energy level and the reached energy level have agreed. Therefore, the radio-frequency signal for extraction is not applied. The timing system 50, on the other hand, repeatedly outputs the extraction timing signal 512 and the energy change timing signal 513 until the target energy has been reached. In accordance with the timing signals from the timing system 50, the power supply controller 45 controls the updating of the extraction control data 72*a*, the acceleration control data (energy change control data) 71*b*, the extraction control data 72*b*, and the acceleration control data (energy change control data) 71*c*, in that order. After accelerating the beam until the reached energy has agreed with the target energy Ec, the irradiation controller 44 outputs the extraction permission signal 441. As a result, the application process 74 for the extraction radio-frequency signal is conducted, whereby the beam is then extracted. After completion of beam extraction control, the irradiation controller 44 confirms whether next irradiation data is present. In the present embodiment, since the next irradiation data is absent (Ec is a final energy level), the irradiation controller 44 transmits the irradiation completion signal 445 to the interlock system 60. The interlock system 60 transmits to the timing system 50 the irradiation completion command 612 indicating that a next operating cycle to be controlled is absent. The timing system 50 outputs the deceleration startup timing signal 513. The power supply controller 45 shifts to deceleration control in accordance with the deceleration startup timing signal 513. In deceleration control, the deceleration control data 73*c* corresponding to the immediately previous extraction energy level Ec is selected and the updating control of the deceleration control data 73*c* is started. Based on the deceleration control data 73*c*, deceleration control is conducted to decelerate the beam to the injection energy (Einj) after accelerating the beam to the initial energy (Einit). Thus the history of magnetic fields for each operating cycle is held constant. In timing with the completion of updating of the deceleration control data 73*c*, the timing system 50 outputs the deceleration completion timing signal 514 to complete the irradiation in accordance with the irradiation completion command 612.

The above configuration of the beam system according to the present embodiment enables the system to rapidly achieve controlling extraction beam energy level changes in the synchrotron accelerator and updating the operating cycle.

The following describes embodiments of a method for automatically generating the control pattern data for devices such as the bending magnets 18 of the synchrotron accelerator 13, and embodiments of a device implementing the method. In the following description, the acceleration control data for a first energy level value in the control pattern data used in the multi-energy extraction control described above is referred to as acceleration control pattern data or acceleration pattern data, and corresponding extraction control data is referred to as extraction control pattern data or extraction pattern data. Similarly, the acceleration control data for a second energy level value onward is referred to as energy change control pattern data or energy change pattern data, and corresponding deceleration control data is referred to as deceleration control pattern data or deceleration pattern data. In addition, in the following embodiments, the control pattern data stored into the storage device 42 is provided as time-series data on the internal magnetic field intensity of the synchrotron accelerator.

Figure 9A:
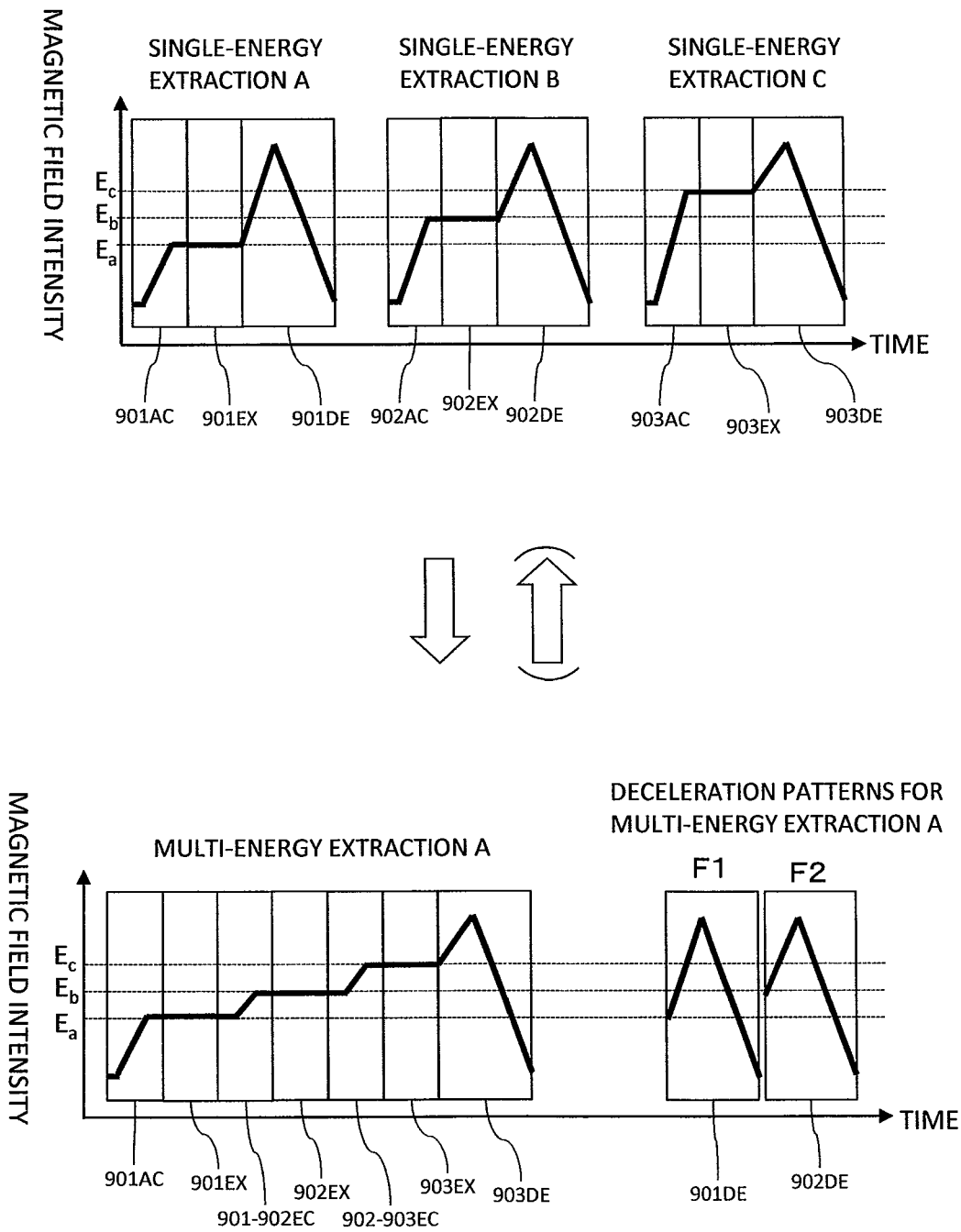
FIG. 9A is a diagram showing a method of generating control pattern data according to another embodiment of the present invention, the method being used to generate new multi-energy extraction pattern data from a plurality of sets of adjusted single-energy extraction pattern data corresponding to different extraction energy levels (in the shown example, three)
Figure 9B:
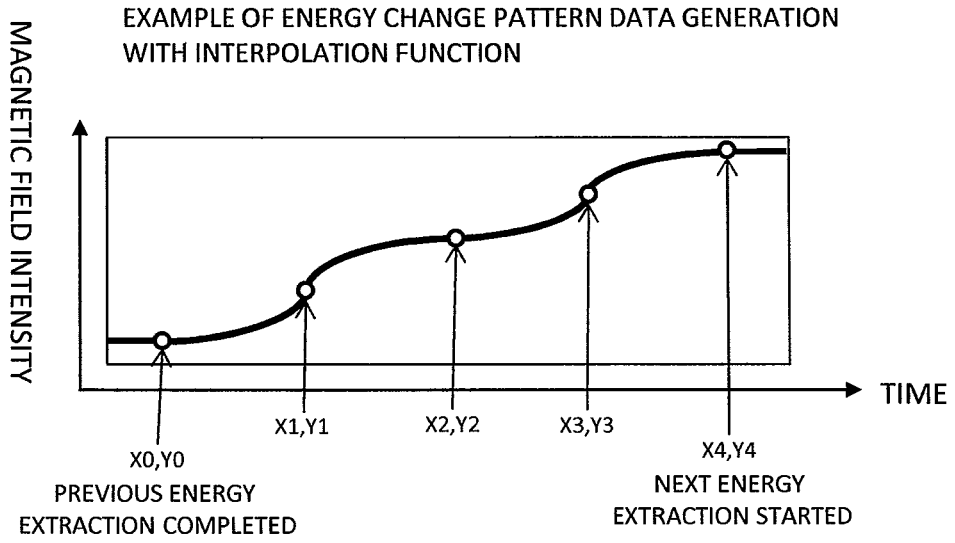
FIG. 9B is a diagram showing a method of generating control pattern data according to yet another embodiment of the present invention, the method being used to generate, by interpolation, energy change control pattern data needed to generate the multi-energy extraction pattern data shown in FIG. 9A.

First, embodiments of a method for generating control pattern data according to the present invention are described below using FIGS. 9A to 12. FIG. 9A is a diagram showing a method for generating new control pattern data for multi-energy extraction, from a plurality of (in the shown example, three) sets of adjusted control pattern data for single-energy extraction, and the three sets of control pattern data correspond to different extraction energy levels. FIG. 9B is a diagram showing a method of generating, by interpolation, the energy change control pattern data needed to generate the control pattern data for multi-energy extraction that is shown in FIG. 9A. Referring to FIGS. 9A and 9B, a horizontal axis denotes time and a vertical axis denotes the magnetic field intensity inside the synchrotron accelerator 13. The magnetic field intensity is the amount of excitation charge required for the electromagnets (e.g., bending magnets 18) of the synchrotron accelerator 13 to cause particles of variable energy to orbit inside the synchrotron accelerator 13. As the energy level of the particles becomes higher, they will orbit faster, and as the particles orbit faster, the magnetic field intensity of the electromagnets used to change a traveling direction of the particles inside the synchrotron accelerator 13 will need to be kept higher.

The new control pattern data generated in FIG. 9A corresponds to the control data used for the multi-energy extraction control of the control system 100 in FIG. 3. The new control pattern data is composed of multi-energy extraction pattern data A for controlling the extraction of a beam of a plurality of energy levels at one operating cycle, and a plurality of sets of deceleration control pattern data (hereinafter referred to simply as deceleration pattern data where appropriate) F1 and F2 that correspond to the plurality of extraction energy level values Ea, Eb (extraction energy level values other than the final energy level value) in multi-energy extraction pattern data A. Multi-energy extraction pattern data A can be used to control the beam extraction of the plurality of energy levels by controlling the relevant electromagnets (in the shown example, the bending magnets 18), and the plurality of deceleration control pattern data sets F1, F2 that correspond to the plurality of extraction energy level values Ea, Eb can be used to realize rapid shifting from whatever extraction energy level to deceleration control. The present invention may be applied to generating such control pattern data composed only of multi-energy extraction pattern data A, that is described in Non-Patent Document 1 and JP-2011-124149-A, and in this case, the new control pattern data generated will not include the plurality of deceleration control pattern data sets F1, F2.

A plurality of sets of existing adjusted control pattern data for single-energy extraction A, B, C that are shown in an upper row of FIG. 9A (hereinafter, these sets of control pattern data are referred to as single-energy extraction pattern data sets A, B, C) are used to newly generate multi-energy extraction pattern data A and deceleration control pattern data sets F1, F2 shown in FIG. 9A. In the shown example, since new control pattern data A generated has three extraction energy level values Ea, Eb, Ec adjusted single-energy extraction pattern data sets A, B, C are each a set of pattern data having extraction energy level value Ea, Eb, or Ec, respectively.

Within the storage device 42 (see FIG. 4, e.g.) of the particle beam system 1, a large number of sets of adjusted control pattern data for single-energy extraction are prestored and single-energy extraction pattern data sets A, B, C are selected from these sets of adjusted control pattern data, with extraction energy as an index.

Referring to the upper row of FIG. 9A, each of the plurality of adjusted single-energy extraction pattern data sets A, B, C corresponding to the different extraction energy levels is first partitioned/divided into an acceleration control pattern data set (hereinafter referred to as acceleration pattern data set) 901AC, 902AC, or 903AC, extraction control pattern data sets (hereinafter referred to as extraction pattern data sets) 901EX, 902EX, 903EX, and deceleration control pattern data sets (hereinafter referred to as deceleration pattern data sets) 901DE, 902DE, 903DE. These pattern data sets are next defined as data modules intended to form multi-energy extraction pattern data A and the deceleration control pattern data sets F1, F2. The data modules are each partitioned/divided in association with time (clock time information). For example, the acceleration pattern data set 901AC is defined as the data module ranging between a starting clock time of t0 of the acceleration pattern data and an ending clock time of t1 thereof.

In addition, energy change pattern data sets 901-902EC, 902-903EC (energy change control pattern data sets; hereinafter referred to simply as energy change pattern data sets) not included in the single-energy extraction pattern data A, B, C of FIG. 9A and required for the formation of multi-energy extraction pattern data A are each generated using a predefined interpolation function. A method of generating energy change pattern data using the interpolation function is described below using FIG. 9B.

Referring to FIG. 9B, coordinates (X0, Y0) of the previous energy level value and coordinates (X4, Y4) of a target energy level value, both required for the generation of energy change pattern data, are determined first. The coordinates X0, X4 on the horizontal axis denote time, and the coordinates Y0, Y4 on the vertical axis denote magnetic field intensity. Time X0 is temporarily set to be 0, and time X4 is set to be the time required for the synchrotron accelerator 13 to accelerate the remaining beam to the next energy level. Magnetic field intensity Y0 is determined according to the particular extraction energy level of the immediately previous extraction pattern data, and magnetic field intensity Y4 is determined according to a particular extraction energy level of immediately following extraction pattern data. For energy change pattern data sets 901-902EC, for example, magnetic field intensity Y0 is set as the magnetic field intensity matching the extraction energy level Ea of the immediately previous extraction pattern data set 901EX, and magnetic field intensity Y4 is set as the magnetic field intensity matching the extraction energy level Eb of the immediately following extraction pattern data 902EX. For energy change pattern data sets 902-903EC, magnetic field intensity Y0 is set as the magnetic field intensity matching the extraction energy level Eb of the immediately previous extraction pattern data set 902EX, and magnetic field intensity Y4 is set as the magnetic field intensity matching the extraction energy level Ec of the immediately following extraction pattern data set 903EX.

Next, appropriate points of interpolation are determined according to the function to be used, and then the coordinates (X0, Y0) of the previous energy level value, the coordinates (X4, Y4) of the target energy level value, and the determined points of interpolation are entered into the interpolation function. This enables automatic generation of the energy change pattern data.

As an example of interpolation points in FIG. 9B, X1, X2, X3 are calculated by dividing an interval from time X0 to time X4 into four equal sections, Y1, Y2, Y3 are calculated by dividing an interval from time Y0 to time Y4 into four equal sections, and the thus-calculated values are set as coordinates (X1, Y1) (X2, Y2) (X3, Y3) positioned between (X0, Y0) and (X4, Y4). These interpolation points, the coordinates of the previous energy level value, and the coordinates of the target energy level value are used to automatically generate the energy change pattern data. The kinds of functions that can be used for the interpolation are zeroth-order interpolation functions, linear interpolation functions, parabolic interpolation functions, polynomial interpolation functions, cubic interpolation functions, cubic convolution functions, Lagrange interpolation functions, spline interpolation functions, Sinc functions, and Lanczos interpolation functions. The use of these functions allows automatic generation of the energy change pattern data sets 901-902EC, 902-903EC shown in FIG. 9B.

The energy change pattern data sets 901-902EC, 902-903EC that have been generated using the above-mentioned interpolation functions are combined with the initial acceleration pattern data set 901AC, extraction pattern data sets 901EX, 902EX, 903EX, and deceleration pattern data set 903DE that are selected from the data modules obtained beforehand by partitioning/dividing adjusted single-energy extraction pattern data sets A, B, C. Thus, the multi-energy extraction pattern data A shown in FIG. 9B is formed. The deceleration pattern data sets 901DE, 902DE are formed intact as the deceleration pattern data sets F1, F2.

As can be seen from the above, in the present embodiment, since multi-energy extraction pattern data A and the deceleration pattern data sets F1, F2 are generated from adjusted single-energy extraction pattern data sets A, B, C, there is no need to perform readjustments after the generation, leading to reduction in the number of generating steps. This generating method enables automatic generation of the control pattern data including new multi-energy extraction pattern data, based on the plurality of adjusted single-energy extraction pattern data sets.

An example in which control pattern data different from the above is automatically generated is described below using FIG. 9A once again. In this example, single-energy extraction pattern data is generated from the control pattern data including adjusted multi-energy extraction pattern data.

Adjusted multi-energy extraction pattern data A shown in FIG. 9A is partitioned/divided into an acceleration pattern data set 901AC, extraction pattern data sets 901EX, 902EX, 903EX, energy change pattern data sets 901-902EC, 902-903EC, and a deceleration pattern data set 903DE. Next, these data sets and the adjusted deceleration pattern data sets F1, F2 (deceleration pattern data sets 901DE, 902DE) that are originally divided sections are defined as data modules that form new control pattern data. The acceleration pattern data 901AC, the extraction pattern data 901EX, and the deceleration pattern data set 901DE corresponding to the extraction pattern data 901EX are selectively combined from the above data modules to automatically generate single-energy extraction pattern data A shown in the upper row of FIG. 9A. As in the immediately previous example, single-energy extraction pattern data A formed from the adjusted deceleration pattern data set F1 as well as the acceleration pattern data set 901AC and extraction pattern data set 901EX that have been obtained by dividing adjusted multi-energy extraction pattern data A requires no readjustment, which in turn leads to reduction in the number of generating steps. Single-energy extraction pattern data sets B, C can also be generated in substantially the same manner as above.

The data-generating method described above is only an embodiment of the present invention, and the invention is neither limited to the number of extraction energy levels used in the above embodiment, nor limited to the kinds of control pattern data used for the generation.

The example of interpolation point calculation that has been described above is also an embodiment of the present invention, and the invention is neither limited to the number of interpolation points and coordinate calculation method used in the above embodiment.

Other examples of generating control pattern data according to the present invention are described below using FIGS. 10A and 10B. In these examples, new control pattern data for multi-energy extraction is generated by division of adjusted control pattern data for multi-energy extraction.

Figure 10A:
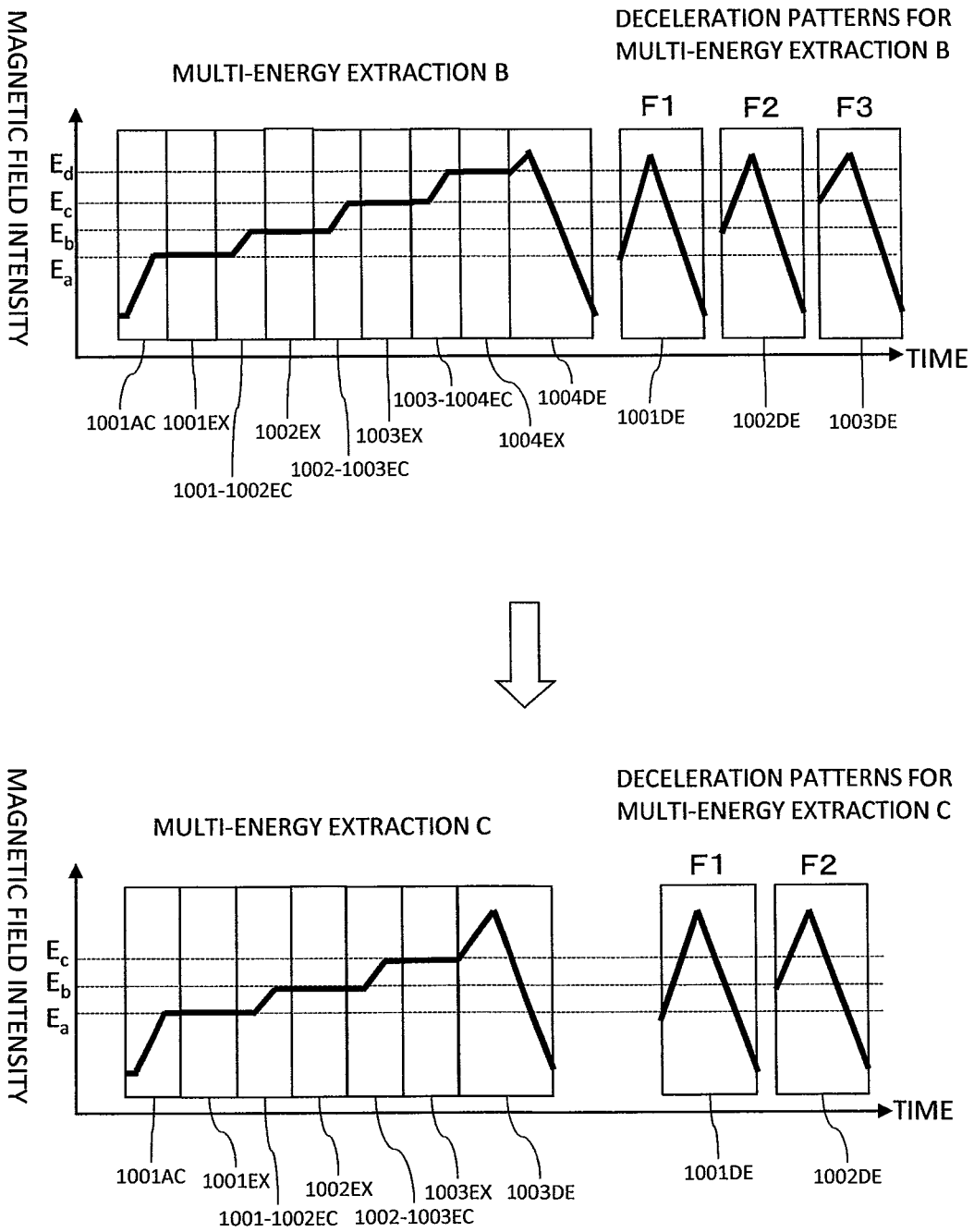
FIG. 10A is a diagram showing a method of generating control pattern data according to a further embodiment of the present invention, the method being used to generate new multi-energy extraction pattern data from adjusted multi-energy extraction pattern data.
Figure 10B:
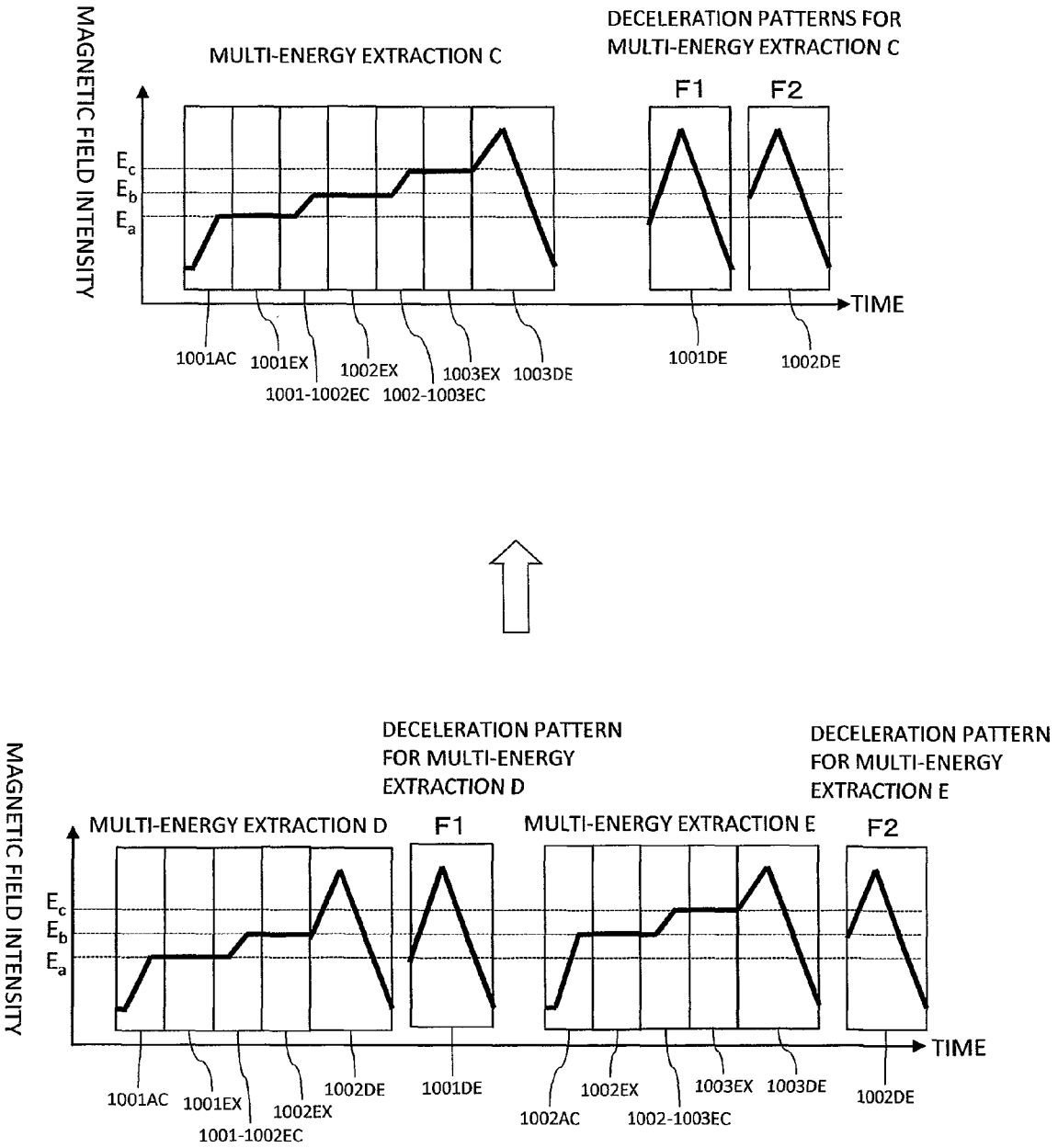
FIG. 10B is a diagram showing another method of generating control pattern data according to a further embodiment of the present invention, the method being used to generate new multi-energy extraction pattern data from adjusted multi-energy extraction pattern data.

FIG. 10A is a diagram showing a method of generating new multi-energy extraction control pattern data from adjusted multi-energy extraction control pattern data, and FIG. 10B is a diagram showing a method of generating new multi-energy extraction control pattern data from adjusted multi-energy extraction control pattern data. Referring to FIGS. 10A and 10B, a horizontal axis denotes time and a vertical axis denotes the magnetic field intensity inside the synchrotron accelerator 13.

Referring to FIG. 10A, adjusted multi-energy extraction control pattern data is composed of multi-energy extraction pattern data B, and a plurality of sets of deceleration control pattern data sets F1, F2, F3 (1001DE, 1002DE, 1003DE) that correspond to the plurality of extraction energy level values Ea, Eb, Ec (extraction energy level values other than the final energy level value) in multi-energy extraction pattern data B. Adjusted multi-energy extraction pattern data B in FIG. 10A is partitioned/divided into an acceleration pattern data set 1001AC, extraction pattern data sets 1001EX, 1002EX, 1003EX, 1004EX, energy change pattern data sets 1001-1002EC, 1002-1003EC, 1003-1004EC, and a deceleration pattern data set 1003DE. Next, these data sets and the adjusted deceleration pattern data sets 1001DE, 1002DE, 1003DE that are originally divided sections are defined as data modules that form new control pattern data. This data module is also divided in association with time (clock time information).

In FIG. 10A, new adjusted multi-energy extraction pattern data C is generated by conducting a data combination based on the data modules obtained from adjusted control pattern data. More specifically, multi-energy extraction pattern data C is a combination of the acceleration pattern data set 1001AC, the extraction pattern data set 1001EX, the energy change pattern data set 1001-1002EC, the extraction pattern data set 1002EX, the energy change pattern data set 1002-1003EC, the extraction pattern data set 1003EX, and the deceleration pattern data set 1003DE. These pattern data sets can all be obtained by dividing multi-energy extraction pattern data B. In addition, the deceleration pattern data sets F1, F2 corresponding to the extraction energy level values Ea, Eb (extraction energy level values other than the final energy level value) in multi-energy extraction pattern data C can be obtained from the deceleration pattern data sets F1, F2 (1001DE, 1002DE) for multi-energy extraction pattern data B.

In FIG. 10A, the multi-energy extraction pattern data C and the deceleration control pattern data sets F1, F2 have been generated from adjusted multi-energy extraction pattern data B and the deceleration control pattern data sets F1 to F3. If this concept is applied, the control pattern data for multi-energy extraction that has an N number of energy levels of extraction control pattern data can be used to generate either the single-energy extraction pattern data having a common initial acceleration pattern data set 1001AC, or the multi-energy extraction pattern data having two to a maximum of N−1 energy levels of extraction control pattern data.

Alternatively, if as shown in FIG. 10B, two sets of different multi-energy extraction pattern data, D, E and deceleration control pattern data sets F1, F2 are present, generating data modules by dividing multi-energy extraction pattern data sets D, E similarly to the above enables the generation of the control pattern data including both of multi-energy extraction pattern data C and the deceleration control pattern data sets F1, F2. Using the data modules generated from the plurality of adjusted control pattern data for multi-energy extraction in this manner, new multi-energy extraction control pattern data can be generated.

The data-generating methods described above are only embodiments of the present invention, and the invention is neither limited to the number of extraction energy levels used in the above embodiment, nor limited to the kinds of control pattern data used for the generation.

Figure 12:
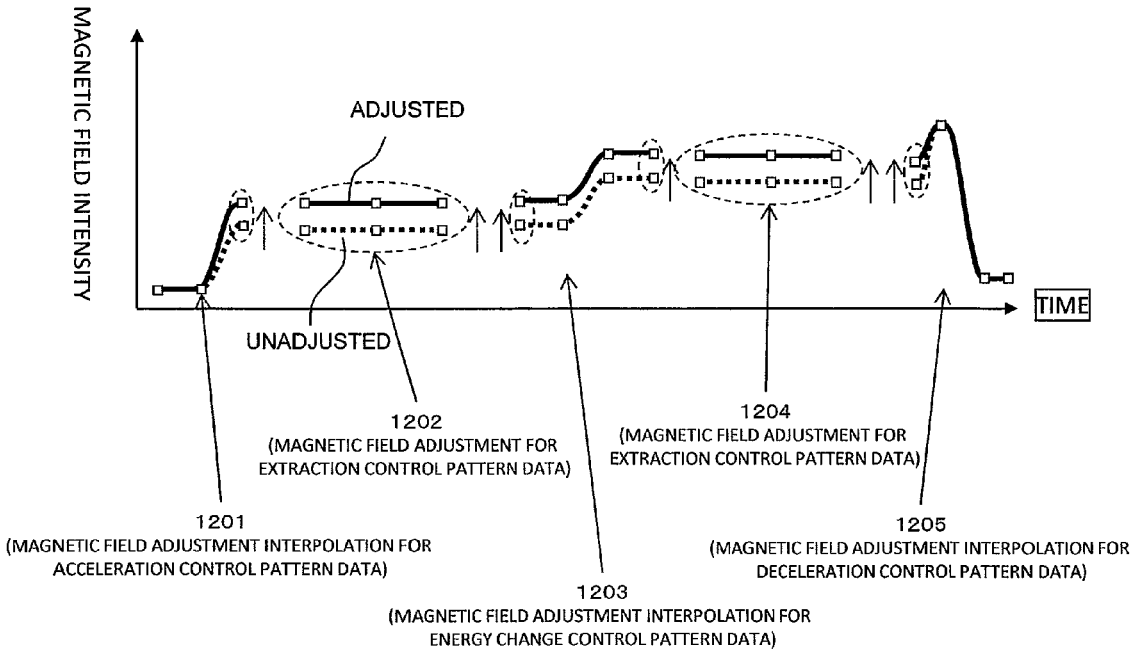
FIG. 12 is a diagram showing the interpolation for residual magnetic field adjustment.

Examples of adjusting multi-energy extraction control pattern data for residual magnetic fields in the above examples are described below using FIGS. 11A, 11B, and 12. FIG. 11A is an explanatory diagram that illustrates residual magnetic field adjustment during conventional single-energy extraction, FIG. 11B is a diagram showing a chart (table) of adjustment values used for the residual magnetic field adjustment in one of the examples described below, and FIG. 12 is a diagram showing the interpolation for the residual magnetic field adjustment.

Referring to FIG. 11A, in a conventional single-energy extraction process, deceleration pattern data sets 1101DE, 1102DE, 1103DE that include initialization patterns IN1, IN2, 1N3, respectively, are present after the extraction, and these sets of deceleration pattern data reset the effects of magnetic fields that occur after the beam extraction, that is, residual magnetic fields. However, during the multi-energy extraction that involves extracting the energy of a plurality of different levels without decelerating it, residual magnetic fields occur in the electromagnets forming the particle beam system 1, and these magnetic fields affect subsequent magnetic field intensity of the accelerator, hence affecting extraction accuracy as a result. It is therefore necessary to calculate the effects of the residual magnetic fields and adjust the control pattern data.

In the particle beam system capable of extracting a maximum of N levels of energy in one operating cycle, since adjustment values for the residual magnetic fields are affected by the magnetic field intensity obtained during pre-extraction, the residual magnetic field adjustment values in the extraction pattern data each differ in the amount of adjustment according to the pre-extraction magnetic field intensity, and these differences exist in the entire set of extraction pattern data from the first (initial) energy level to the Nth energy level. To accommodate these differences in the amount of adjustment, as shown in FIG. 11B, extraction energy levels A to G and to which of the first to Nth levels of extraction in the control pattern data the extraction energy levels each correspond are defined in a form of a chart and the respective adjustment values are provided in advance. Before operation is started, the adjustment values are read in from the chart shown in FIG. 11B, and after the adjustment values have been incorporated into each set of pattern data, operation is started and the residual magnetic field adjustment is conducted. The adjustment values may be incorporated into the pattern data sets by storing the adjustment value as a value added to the pattern data, and then reading in this value when starting operation. The addition of the adjustment value to the pattern data may be performed when operation is started.

The residual magnetic field adjustment is conducted upon the extraction pattern data, and the pattern data (energy change pattern data or acceleration pattern data) positioned in immediate front of the adjusted extraction pattern data, and the pattern data (energy change pattern data or deceleration pattern data) positioned at immediate rear of the adjusted extraction pattern data need to be regenerated for matching to the adjusted extraction pattern data.

A case in which, as shown in FIG. 12, multi-energy extraction pattern data with two energy levels of extraction pattern data requires magnetic field adjustment is described below as an actual example of magnetic field adjustment.

In FIG. 12, adjustment values for extraction pattern data sets 1202, 1204 are read in from the chart of FIG. 11B, then the adjustment values are added to the extraction pattern data sets 1202, 1204, and adjusted extraction pattern data sets 1202, 1204 are generated. Dashed lines in FIG. 12 denote the unadjusted extraction pattern data, and solid lines denote the adjusted extraction pattern data. After the adjustment of the extraction pattern data sets 1202, 1204, interpolation takes place so that the pattern data sets 1201, 1203, 1205 immediately preceding or immediately following the adjusted extraction pattern data connect to this data to adjust the control pattern data. Although not shown in FIG. 12, the deceleration pattern data corresponding to the extraction energy level values in the adjusted extraction pattern data may likewise be adjusted by interpolation. In addition, the interpolation may be done in substantially the same manner as in the example of FIG. 9B.

A method of creating the chart of residual magnetic field adjustment, shown in FIG. 11B, is described below. The adjustment values required for the residual magnetic field adjustment differ according to shapes and other factors of the devices constituting the synchrotron accelerator, so the effects of the residual magnetic fields need to be measured for each magnetic field intensity level and listed in a format of a chart. For example, if the chart is formed in the format of FIG. 11B using a particle beam system capable of extracting energy in a 50-MeV to 249.5-MeV range (199.5 MeV in spread between maximum and minimum extractable energy levels) at intervals of 0.5 MeV in first extractable energy level and having a capacity of 20 extraction levels, independent listing of control pattern data for each first extractable energy level will require 400 lines and 20 rows, so there will be a need to measure 8,000 kinds of data in all as residual magnetic field adjustment values. Instead, however, if residual magnetic field adjustment values are measured at 5-MeV first extractable energy level intervals in steps of 10 extraction levels, the measured adjustment values are set as interpolation points, the interpolating method used in the example of FIG. 9B is applied, and a chart is created. In this case, the number of adjustment values to be measured can be reduced from 8,000 to 80 by using interpolation, and thus the number of steps involved with the data measurement of the residual magnetic field adjustment values can also be correspondingly reduced.

The above data-generating method is only an embodiment of the present invention, and the invention is not limited to the interpolation points (measurements at 5-MeV intervals in steps of 10 extraction levels) in the above example and can be applied to any number of interpolation points.

While the above residual magnetic field adjustment is applied to generating multi-energy extraction control pattern data from single-energy extraction control pattern data as shown in the examples of FIGS. 9A and 9B, the generation of new multi-energy extraction control pattern data from existing multi-energy extraction control pattern data, as shown in the examples of FIGS. 10A and 10B, can likewise be realized by creating a chart for the residual magnetic field adjustment and conducting this adjustment.

Figure 13:
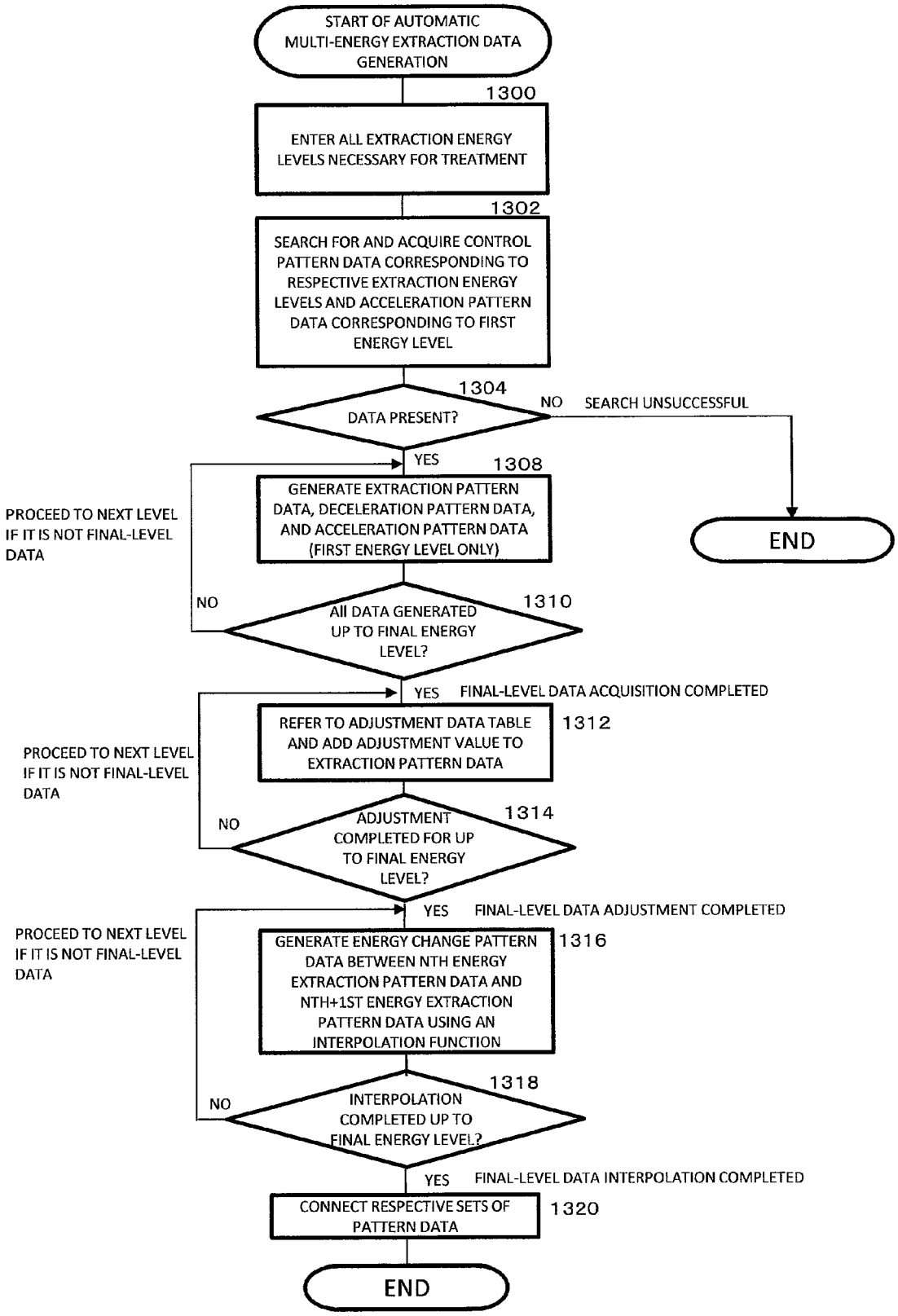
FIG. 13 is a flowchart relating to an embodiment of a data generator characterizing the present invention, the flowchart showing a processing sequence in which the data generator generates control pattern data automatically.

Next, an embodiment of a device which implements one of the above methods of generating control pattern data is described below using FIG. 13. As described above, in the embodiment of the particle beam system 1 according to the present invention, for example, the main controller 41 shown in FIG. 4 doubles as a data generator, and the main controller 41 as a data generator, automatically generates the control pattern data for the bending magnets 18 and other devices constituting the synchrotron accelerator 13. FIG. 13 is a flowchart showing a processing sequence in which the data generator (the main controller 41) automatically generates the control pattern data for the multi-energy extraction.

Referring to FIG. 13, an operator such as a doctor first clicks a starting button on an operations screen using an operating device, such as a mouse, that is connected to the main controller 41. The main controller 41 then starts a program that generates control data. Next, on the basis of irradiating parameters for a certain patient assumed, the operator enters into the main controller 41 the first and all other extractable energy level values necessary for the treatment of the patient (step 1300). Upon receiving all the entered extractable energy level values necessary for the treatment of the patient, the main controller 41 accesses the storage device 42 and then uses each of these extractable energy levels as an index to search for and acquire the adjusted control pattern data corresponding to the index (step 1302). A large number of sets of adjusted control pattern data (in any one of the data-generating methods shown as examples in FIGS. 9A and 9B, adjusted control pattern data that includes single-energy extraction control pattern data sets A, B, C) are prestored within the storage device 42. The main controller 41 next determines whether the adjusted control pattern data that has been acquired includes the adjusted control pattern data corresponding to all the extractable energy levels necessary for the treatment of the patient, and the acceleration pattern data corresponding to the first extractable energy level (step 1304). For example, in any one of the data-generating methods shown as examples in FIGS. 9A and 9B, the main controller 41 determines whether the acquisition of all single-energy extraction control pattern data corresponding to each extractable energy level has been successful. If the acquisition of all corresponding pattern data is determined not to be successful, the main controller 41 terminates processing. If the acquisition of all corresponding pattern data is determined to be successful, the main controller 41 first generates extraction pattern data and deceleration pattern data by, as described above, dividing the adjusted control pattern data corresponding to the first extractable energy level (i.e., in any one of the data-generating methods shown as examples in FIGS. 9A and 9B, single-energy extraction control pattern data A) into data modules (step 1308). The main controller 41 also generates acceleration pattern data (initial acceleration control pattern data) for the first energy level. Next, the main controller 41 determines whether all pattern data up or down to the final energy level has been generated (step 1310). If it is determined that not all pattern data up or down to the final energy level is generated, the main controller 41 proceeds to the generation of data of next energy level and then as in the case of the first energy level, generates extraction pattern data and deceleration pattern data by dividing the adjusted control pattern data corresponding to the next extractable energy level (i.e., in any one of the data-generating methods shown as examples in FIGS. 9A and 9B, single-energy extraction control pattern data B) into data modules (steps 1308→1310). In this way, the main controller 41 generates all pattern data up or down to the final energy level, that is, data modules. Next as described in the third example of a data-generating method, the main controller 41 reads in the residual magnetic field adjustment values relevant to the extraction pattern data of each energy level, from the residual magnetic field adjustment data chart (table) shown in FIG. 11B, then adds the adjustment values to the extraction control pattern data that has been generated by dividing single-energy extraction control pattern data B, and generates adjusted extraction pattern data (step 1312). The main controller 41 repeats the adjustment for all other energy levels up or down to the final energy level (by executing step 1314 and returning to step 1312 as appropriate). Upon completion of the adjustment of all pattern data up or down to the final energy level, as described in the examples of a data-generating method that are shown in FIGS. 9A and 9B, the main controller 41 generates, by interpolation, the energy change pattern data connecting the extraction pattern data of the Nth energy level and that of the N+1th energy level together (step 1316). When the generation of the energy change pattern data by interpolation is repeated for all energy levels up or down to the final energy level (by executing step 1318 and returning to step 1316 as appropriate) and the generation of the energy change pattern data by interpolation for all energy levels up or down to the final energy level is completed, the main controller 41 connects the plurality of pattern data sets of the energy levels together, thus generating a succession of multi-energy extraction control pattern data (step 1320). After this, the multi-energy extraction control pattern data and the deceleration pattern data corresponding to extractable energy levels other than the final one are saved as control pattern data in the storage device 42. This completes the automatic generation of the control pattern data.

In accordance with the present invention, the control pattern data including new multi-energy extraction pattern data is generated from a plurality of sets of single-energy extraction pattern data.

The generation of multi-energy extraction control pattern data from single-energy extraction control pattern data (i.e., the generation of control data in the examples of FIGS. 9A and 9B) has been described in the description of the processing sequence of the data generator. Alternatively, this processing sequence may be applied to the generation of multi-energy extraction control pattern data from other multi-energy extraction control pattern data (i.e., the generation of control data in the examples of FIGS. 10A and 10B). Further alternatively, the processing sequence may be applied to the generation of multi-energy extraction control pattern data from a combination of single-energy extraction control pattern data and other multi-energy extraction control pattern data.

Figure 14:
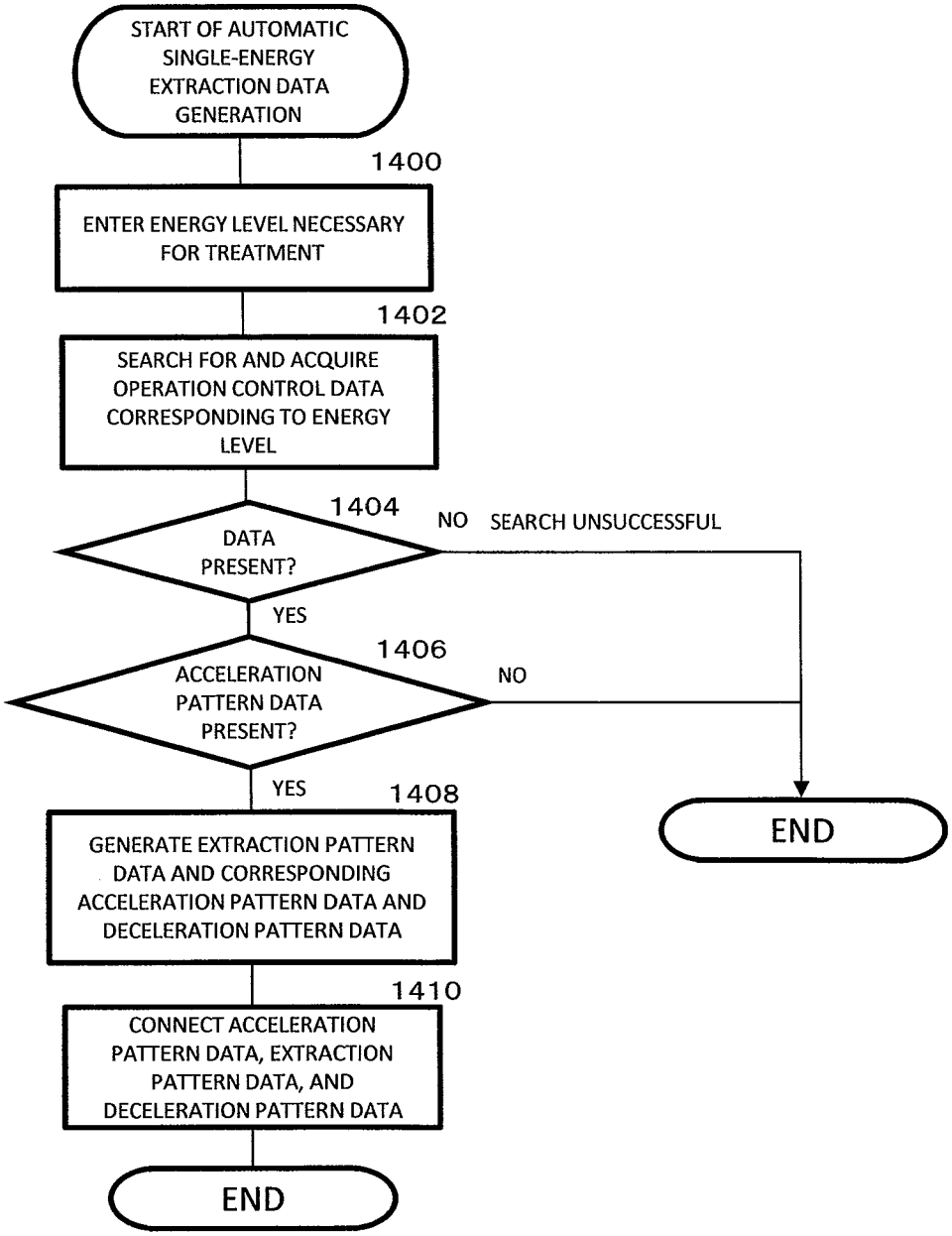
FIG. 14 is a flowchart relating to another embodiment of the data generator characterizing the present invention, the flowchart showing a processing sequence in which the data generator automatically generates single-energy extraction pattern data from adjusted multi-energy extraction pattern data.

FIG. 14 is a flowchart showing a processing sequence in which the main controller 41 automatically generates single-energy extraction control pattern data from adjusted multi-energy extraction control pattern data.

Referring to FIG. 14, an operator such as a doctor first clicks a starting button on an operations screen using an operating device, such as a mouse, connected to the main controller 41. The main controller 41 then starts a program that generates the control data for single-energy extraction. Next, on the basis of irradiating parameters for a certain patient assumed, the operator enters into the main controller 41 the first and all other extractable energy level values necessary for the treatment of the patient (step 1400). Upon receiving the entered energy level values, the main controller 41 accesses the storage device 42 and then uses each of these extractable energy levels as an index to search for and acquire the adjusted control pattern data corresponding to the index (step 1402). A large number of sets of adjusted control pattern data (in the data-generating method shown as an example in FIG. 9A, such a large number of sets of adjusted multi-energy extraction control pattern data that each include multi-energy extraction control pattern data A) are prestored within the storage device 42. The main controller 41 next determines whether the acquisition of adjusted multi-energy extraction control pattern data has been successful (step 1404). For example, in the data-generating method shown as an example in FIG. 9A, the main controller 41 determines whether the acquisition of multi-energy extraction pattern data A and the deceleration pattern data sets F1, F2 has been successful. If the acquisition of the corresponding pattern data is determined not to be successful, the main controller 41 terminates processing. If the acquisition of the corresponding pattern data is determined to be successful, the main controller 41 next determines whether the acceleration pattern data corresponding to the entered energy level values is present in the stored multi-energy extraction control pattern data (step 1406). If the acceleration pattern data is absent, the main controller 41 terminates processing. If the acceleration pattern data is present, the main controller 41 first generates acceleration pattern data, extraction pattern data, and deceleration pattern data by, as described above, dividing the multi-energy extraction pattern data included in the acquired multi-energy extraction control pattern data (i.e., in the data-generating method shown as an example in FIG. 9A, multi-energy extraction pattern data A) into data modules (step 1408). Next, the main controller 41 connects the acceleration pattern data corresponding to the entered energy levels, the corresponding extraction pattern data, and the corresponding deceleration pattern data together, thus generating a succession of single-energy extraction control pattern data (step 1410). After this, the main controller 41 saves the single-energy extraction control pattern data in the storage device 42 to complete the automatic generation of the control pattern data.

In accordance with the present invention, new control pattern data for single-energy extraction is automatically generated from adjusted multi-energy extraction control pattern data.

While the main controller 41 in any one of the embodiments described above doubles as the data generator that implements a method of generating control data, an independent controller may instead be provided and a function of the data generator may be assigned to the controller. In this case, the independent controller is preferably connected to the main controller 41 and exchanges data by communications. In addition, generated data modules may be saved in a database storage medium other than the storage device 42.

What is claimed is:

1. A particle beam system, comprising:

a synchrotron accelerator constructed to accelerate and extract an ionized particle beam;

a controller configured to control devices constituting the synchrotron accelerator; and a data generator configured to:

generate a plurality of adjusted data modules including acceleration pattern data, extraction pattern data, and deceleration pattern data, the plurality of adjusted data modules being generated by dividing adjusted control pattern data from a plurality of sets of single-energy extraction pattern data used to control the devices constituting the synchrotron accelerator; and combine the plurality of adjusted data modules to generate new control pattern data containing multi-energy extraction pattern data used for the controller.

2. The particle beam system according to claim 1, wherein:

the data generator generates energy change pattern data necessary for the multi-energy extraction pattern data, by interpolating extraction pattern data before an energy level change, and extraction pattern data after the energy level change, by use of an interpolation function.

3. The particle beam system according to claim 1, wherein:

the data generator generates, as the new control pattern data, the multi-energy extraction pattern data and deceleration control pattern data which corresponds to those extraction energy level values of extraction control pattern data that are other than a final energy level value included in the multi-energy extraction pattern data.

4. The particle beam system according to claim 1, wherein:

the data generator stores, in association with extraction energy and extraction levels, a plurality of adjustment values each for adjusting magnetic field residues occurring in the devices after the beam extraction from the synchrotron accelerator, and the data generator conducts residual magnetic field adjustments using the adjustment values when the new control pattern data is generated.

5. The particle beam system according to claim 4, wherein:

the data generator acquires part of the adjustment values by measurement, and calculates the remaining adjustment values by interpolating the adjustment values that have been acquired by the measurement.

6. The particle beam system according to claim 1, further comprising:

a data storage device with a plurality of sets of adjusted control pattern data saved therein, wherein the data generator generates the plurality of adjusted data modules by selecting, from the plurality of sets of adjusted control pattern data, the corresponding sets of adjusted control pattern data that is required for treatment and dividing the selected sets of adjusted control pattern data.

7. A method of generating control pattern data for a particle beam system including a synchrotron accelerator constructed to accelerate and extract an ionized particle beam, and a controller configured to control devices constituting the synchrotron accelerator, the control pattern data being used for the controller to control the devices constituting the synchrotron accelerator, the method comprising:

generating a plurality of adjusted data modules including acceleration pattern data, extraction pattern data, and deceleration pattern data, by dividing adjusted control pattern data using a plurality of sets of single-energy extraction pattern data used to control the devices constituting the synchrotron accelerator; and combining the plurality of adjusted data modules to generate new control pattern data containing multi-energy extraction pattern data used for the controller.

8. The method of generating control pattern data according to claim 7, further comprising:

generating energy change pattern data necessary for the multi-energy extraction pattern data interpolating extraction pattern data obtained before an energy level change, and extraction pattern data obtained after the energy level change, by use of an interpolation function.

9. The method of generating control pattern data according to claim 7, further comprising:

storing, in association with extraction energy and extraction levels, a plurality of adjustment values each for adjusting magnetic field residues occurring in the devices after the beam extraction from the synchrotron accelerator; and conducting residual magnetic field adjustments using the adjustment values when the new control pattern data is generated.

10. The method of generating control pattern data according to claim 9, further comprising:

acquiring part of the adjustment values by measurement; and calculating the remaining adjustment values by interpolating the adjustment values that have been acquired by the measurement.

11. The method of generating control pattern data according to claim 7, further comprising:

generating, as the new control pattern data, the multi-energy extraction pattern data and deceleration control pattern data which corresponds to those extraction energy level values of extraction control pattern data that are other than a final energy level value included in the multi-energy extraction pattern data.

12. The method of generating control pattern data according to claim 7, further comprising:

saving a plurality of sets of adjusted control pattern data in a data storage device; and generating the plurality of adjusted data modules by selecting, from the plurality of sets of adjusted control pattern data, the corresponding sets of adjusted control pattern data that is required for treatment and dividing the selected sets of adjusted control pattern data.

* * * * *